US009298156B2

(12) United States Patent
Fukuoka et al.

(10) Patent No.: US 9,298,156 B2
(45) Date of Patent: Mar. 29, 2016

(54) TONER CARTRIDGE SUPPORTING APPARATUS, IMAGE FORMING APPARATUS USING THE SAME, AND TONER CARTRIDGE SUPPORTING METHOD

(75) Inventors: Shintaro Fukuoka, Osaka (JP); Hitoshi Nagahama, Osaka (JP)

(73) Assignee: SHARP KABUSHIKI KAISHA, Osaka-shi (JP)

( * ) Notice: Subject to any disclaimer, the term of this patent is extended or adjusted under 35 U.S.C. 154(b) by 337 days.

(21) Appl. No.: 13/560,033

(22) Filed: Jul. 27, 2012

(65) Prior Publication Data

US 2013/0028617 A1 Jan. 31, 2013

(30) Foreign Application Priority Data

Jul. 28, 2011 (JP) ..... 2011-165790

(51) Int. Cl.

*G03G 15/08* (2006.01)
*G03G 21/16* (2006.01)
*G03G 15/00* (2006.01)

(52) U.S. Cl.

CPC ..... *G03G 21/1633* (2013.01); *G03G 15/502* (2013.01); *G03G 15/556* (2013.01); *G03G 21/1676* (2013.01); *G03G 15/0834* (2013.01); *G03G 15/0856* (2013.01); *G03G 15/0868* (2013.01); *G03G 2221/169* (2013.01)

(58) Field of Classification Search

CPC ..... G03G 15/0834; G03G 15/0868; G03G 15/556; G03G 15/1633; G03G 2215/0665; G03G 2221/169

USPC ..... 399/27, 258, 262

See application file for complete search history.

(56) References Cited

U.S. PATENT DOCUMENTS

| | | | | |
|---|---|---|---|---|
| 6,097,903 | A * | 8/2000 | Yahata et al. | 399/27 |
| 7,778,556 | B2 | 8/2010 | Ohkawa et al. | |
| 2006/0159467 | A1 | 7/2006 | Takahashi | |
| 2007/0223947 | A1 | 9/2007 | Ohkawa et al. | |
| 2009/0290905 | A1 * | 11/2009 | Mizuno et al. | 399/111 |
| 2010/0272452 | A1 | 10/2010 | Tsukijima | |
| 2010/0329704 | A1 | 12/2010 | Tachibana | |

FOREIGN PATENT DOCUMENTS

| | | |
|---|---|---|
| CN | 101046657 A | 10/2007 |
| JP | 04-084158 | 3/1992 |
| JP | 05-066649 | 3/1993 |
| JP | 2003-084534 | 3/2003 |
| JP | 2006-133459 | 5/2006 |
| JP | 2006-145875 | 6/2006 |
| JP | 2004-151209 | 5/2007 |
| JP | 2007-264073 | 10/2007 |
| JP | 2010-256557 | 11/2010 |
| JP | 2011-8142 | 1/2011 |

* cited by examiner

*Primary Examiner* — Benjamin Schmitt
(74) *Attorney, Agent, or Firm* — Nixon & Vanderhye P.C.

(57) ABSTRACT

A toner cartridge supporting apparatus includes a storage portion, an insertion port, an opening/closing cover, a detecting portion for detecting a toner remaining amount, a control portion for controlling the supply of toner, a judging portion to judge whether or not the toner in a toner cartridge is exhausted, a message generating portion for generating a replacement message, a display portion for displaying the message and a toner cartridge replacement icon, and a toner cartridge moving portion. A toner cartridge replacement message is displayed when toner in a toner cartridge has been exhausted. A toner cartridge movement instruction function is performed in response to a user instruction to replace a toner cartridge.

9 Claims, 23 Drawing Sheets

TONER CARTRIDGE SUPPORTING APPARATUS, IMAGE FORMING APPARATUS USING THE SAME, AND TONER CARTRIDGE SUPPORTING METHOD

This Nonprovisional application claims priority under 35 U.S.C. §119(a) on Patent Application No. 2011-165790 filed in Japan on 28 Jul. 2011, the entire contents of which are hereby incorporated by reference.

BACKGROUND OF THE INVENTION

1. Field of the Invention

The present invention relates to a toner cartridge supporting apparatus, an image forming apparatus using the same, and a toner cartridge supporting method, and particularly, relates to a toner cartridge supporting apparatus including a control portion for controlling to supply a toner from an attached toner cartridge, an image forming apparatus using the same, and a toner cartridge supporting method.

2. Description of the Prior Art

Recently, in image forming apparatuses such as copiers, facsimiles and printers, a toner supply apparatus which performs toner supply using a toner cartridge storing a toner therein so as to be able to perform toner supply easily by replacing the toner cartridge when the toner is exhausted.

Proposed as a conventional technology is such that, for example, for a case where a remaining toner in a toner cartridge is decreased and replacement becomes necessary, a display portion for notifying of it is provided, and by operating the display portion, a toner cartridge detaching door corresponding to the toner cartridge which needs to be replaced is selectively opened (see Patent Literature 1; Japanese Patent Application Laid-open No. 2010-256557).

According to this configuration, it is possible to visually show the toner cartridge which needs to be replaced.

SUMMARY OF THE INVENTION

However, in the conventional technology described above, in a recent image forming apparatus using a large-scaled touch panel, when a detaching door is below the large-scaled touch panel, even if the detaching door is opened, the door is hidden by the large-scaled touch panel, thus posing a problem that it is difficult to see from a user.

In addition, when the door is hidden by the large-scaled touch panel, it becomes difficult to hold a toner cartridge, thus posing a problem that the toner cartridge is difficult to be replaced. In particular, when a large toner cartridge with a large capacity is ejected, there is a case where the cartridge is difficult to be taken out with one hand.

The present invention has been made in view of the conventional problems described above, and aims to provide a toner cartridge supporting apparatus which allows, when a toner cartridge is replaced, to confirm the toner cartridge which needs to be replaced easily, and which seeks to improve convenience of the work of replacing the toner cartridge, an image forming apparatus using the same, and a toner cartridge supporting method.

A toner cartridge supporting apparatus, an image forming apparatus using the same, and a toner cartridge supporting method according to the present invention for solving the problems described above are as follows.

The present invention provides a toner cartridge supporting apparatus that includes: a storage portion for storing a toner cartridge; an insertion port for inserting the toner cartridge in the storage portion; an opening/closing cover for covering the insertion port; a detecting portion for detecting a toner remaining amount in the toner cartridge stored in the storage portion; a control portion for controlling to supply a toner from the toner cartridge; a judging portion for judging whether or not the toner in the toner cartridge is exhausted based on a detection result by the detecting portion; a message generating portion for generating a toner cartridge replacement message for notifying that the toner cartridge is to be replaced based on a judgment result by the judging portion; a display portion for displaying the toner cartridge replacement message generated by the message generating portion; a toner cartridge replacement instruction portion for instructing to replace the toner cartridge; and a toner cartridge moving portion for moving the toner cartridge from a toner supply position in the storage portion to an ejection position on a side of the insertion port, and wherein the control portion has a function of causing the display portion to display the toner cartridge replacement message when the judging portion judges that the toner in the toner cartridge is exhausted, and a function of causing the toner cartridge moving portion to move the toner cartridge from the toner supply position to the ejection position when replacement of the toner cartridge is instructed by the toner cartridge replacement instruction portion.

Further, in the present invention, it is preferable that the toner cartridge is inserted in the storage portion in an approximately horizontal direction, and the ejection position of the toner cartridge is arranged in a position that an end portion on the side of the insertion port of the toner cartridge is projected toward an external side of the insertion port from the storage portion.

Further, in the present invention, it is preferable that the display portion is disposed to be projected outward in an approximately horizontal direction side with respect to the insertion port at a top part of the insertion port, and the ejection position of the toner cartridge positioned below the display portion is arranged in a position at which the end portion on the side of the insertion port of the toner cartridge is projected outward in the approximately horizontal direction side with respect to an end portion of the display portion.

Further, in the present invention, it is preferable that as a configuration of the opening/closing cover, the opening/closing cover comprises a convex portion for contacting with the toner cartridge and guiding an opening operation of the opening/closing cover at a position facing the toner cartridge when the toner cartridge moves.

Further, in the present invention, it is preferable that as a configuration of the toner cartridge supporting apparatus, the toner cartridge supporting apparatus comprises an opening portion for opening the opening/closing cover, and the control portion performs control in such a manner that the toner cartridge moving portion moves the toner cartridge to the ejection position after the opening portion opens the opening/closing cover.

Further, in the present invention, it is preferable that the storage portion is configured such that a space cross-sectional area on the side of the insertion port is larger than a space cross-sectional area on an opposite side of the insertion port in a space cross-sectional area in a vertical direction with respect to a longitudinal direction of the toner cartridge stored inside the storage portion.

Further, in the present invention, it is preferable that as a configuration of the storage portion, the storage portion includes a guide member for guiding the toner cartridge along a longitudinal direction of the toner cartridge stored inside the storage portion.

Further, in the present invention, it is preferable that as the toner cartridge moving portion, the toner cartridge moving portion includes a pressing portion for pressing at least a part of the toner cartridge or a pulling portion for pulling at least a part of the toner cartridge.

Further, in the present invention, it is preferable that as a configuration of the display portion, the display portion approximately integrally includes a touch panel or an operation key.

Note that, the touch panel and the operation panel may be provided separately, or a plurality of display portions using a touch panel may be provided, or a display portion for performing only display, that is, a display portion may be provided.

Further, the present invention provides an image forming apparatus includes a toner cartridge supporting apparatus that includes: a storage portion for storing a toner cartridge; an insertion port for inserting the toner cartridge in the storage portion; an opening/closing cover for covering the insertion port; a detecting portion for detecting a toner remaining amount in the toner cartridge stored in the storage portion; a control portion for controlling to supply a toner from the toner cartridge, and wherein the toner cartridge supporting apparatus according to claim 1 is used.

Further, the present invention provides a toner cartridge supporting method includes: a step of detecting a toner remaining amount in a toner cartridge stored in a storage portion; a step of controlling to supply a toner from the toner cartridge; a step of judging whether or not the toner in the toner cartridge is exhausted based on a detection result of detecting the toner remaining amount in the toner cartridge, a step of generating a toner cartridge replacement message that notifies replacement of the toner cartridge based on a judgment result, a step of displaying the toner cartridge replacement message to be generated, and a step of moving the toner cartridge from a toner supply position in the storage portion to an ejection position on a side of the insertion port, a step of displaying the replacement message by means of the display portion when it is judged that the toner in the toner cartridge is exhausted, and a step of moving the toner cartridge from the toner supply position to the ejection position when a user selects the replacement message displayed on the display portion.

According to the toner cartridge supporting apparatus of the present invention, a toner cartridge supporting apparatus includes: a storage portion for storing a toner cartridge; an insertion port for inserting the toner cartridge in the storage portion; an opening/closing cover for covering the insertion port; a detecting portion for detecting a toner remaining amount in the toner cartridge stored in the storage portion; a control portion for controlling to supply a toner from the toner cartridge; a judging portion for judging whether or not the toner in the toner cartridge is exhausted based on a detection result by the detecting portion; a message generating portion for generating a toner cartridge replacement message for notifying that the toner cartridge is to be replaced based on a judgment result by the judging portion; a display portion for displaying the toner cartridge replacement message generated by the message generating portion; a toner cartridge replacement instruction portion for instructing to replace the toner cartridge; and a toner cartridge moving portion for moving the toner cartridge from a toner supply position in the storage portion to an ejection position on a side of the insertion port, and wherein the control portion has a function of causing 2100 when the judging portion judges that the toner in the toner cartridge is exhausted, and a function of causing the toner cartridge moving portion to move the toner cartridge from the toner supply position to the ejection position when replacement of the toner cartridge is instructed by the toner cartridge replacement instruction portion, so that, for example, even when a plurality of toner cartridges of the same color are loaded, it is possible to determine which toner cartridge is to be replaced in one glance and to seek to improve convenience of the replacement work with the toner cartridge held easily.

In addition, it is possible to prevent erroneous ejection of a toner cartridge in which a toner remains from occurring and to prevent toner scattering or toner dropping from a toner supply port of the toner cartridge and contamination in the apparatus.

Further, based on the configuration such that the opening/closing cover is pressed to be opened by moving only the toner cartridge to an ejection position, a driving device for opening the opening/closing cover becomes unnecessary, thus making it possible to provide an inexpensive toner cartridge supporting apparatus with less number of parts.

Further, according to the present invention, the toner cartridge is inserted in the storage portion in an approximately horizontal direction, and the ejection position of the toner cartridge is arranged in a position that an end portion on the side of the insertion port of the toner cartridge is projected toward an external side of the insertion port from the storage portion, so that it is possible to eject the toner cartridge with both hands easily, thus making it possible to perform the work of replacing the toner cartridge easily.

Further, according to the present invention, the display portion is disposed to be projected outward in an approximately horizontal direction side with respect to the insertion port at a top part of the insertion port, and the ejection position of the toner cartridge positioned below the display portion is arranged in a position at which the end portion on the side of the insertion port of the toner cartridge is projected outward in the approximately horizontal direction side with respect to an end portion of the display portion, so that it is possible to save much more area of the toner cartridge to be held, thus making it possible to eject the toner cartridge more easily.

In addition, in a recent situation where a display portion of an operation panel as a display portion is getting larger, even when a toner cartridge is arranged below the display portion, it is possible to seek to improve visibility with the work of replacing the toner cartridge.

Further, according to the present invention, as a configuration of the opening/closing cover, the opening/closing cover includes a convex portion for contacting with the toner cartridge and guiding an opening operation of the opening/closing cover at a position facing the toner cartridge when the toner cartridge moves, so that it is possible to transmit movement of the toner cartridge accurately to the opening/closing cover and to open the opening/closing cover reliably.

Note that, a shape of the convex portion may be formed into a cylindrical shape or a rib shape.

Further, according to the present invention, as a configuration of the toner cartridge supporting apparatus, the toner cartridge supporting apparatus includes an opening portion for opening the opening/closing cover, and the control portion performs control in such a manner that the toner cartridge moving portion moves the toner cartridge to the ejection position after the opening portion opens the opening/closing cover, so that it is possible to perform the work of replacing the toner cartridge, and the toner cartridge does not contact with the opening/closing cover, thus making it possible to eliminate abrasion of the opening/closing cover and to achieve a long operable life for the opening/closing cover.

Further, according to the present invention, the storage portion is formed such that a space cross-sectional area on the side of the insertion port is larger than a space cross-sectional area on an opposite side of the insertion port in a space cross-sectional area in a vertical direction with respect to a longitudinal direction of the toner cartridge stored inside the storage portion, so that it is possible to insert the toner cartridge in the insertion port easily even the insertion port of the toner cartridge is hard to be seen due to the large-scaled display portion.

In particular, when a toner cartridge which has a large toner capacity and large weight is inserted, it is possible to insert the toner cartridge just by pressing after one end of the toner cartridge is supported by the insertion port, thus making it possible to perform the work of replacing the toner cartridge easily.

Further, according to the present invention, as a configuration of the storage portion, the storage portion comprises a guide member for guiding the toner cartridge along a longitudinal direction of the toner cartridge stored inside the storage portion, so that it is possible to insert the toner cartridge in the storage portion easily.

Further, according to the present invention, as the toner cartridge moving portion, the toner cartridge moving portion comprises a pressing portion for pressing at least a part of the toner cartridge or a pulling portion for pulling at least a part of the toner cartridge, so that the opening/closing cover is able to be pressed to be opened by moving only the toner cartridge to an ejection position with a simple configuration, and therefore a driving device for opening the opening/closing cover becomes unnecessary, thus making it possible to provide an inexpensive toner cartridge supporting apparatus and reduce the number of components.

Further, according to the present invention, as a configuration of the display portion, the display portion approximately integrally includes a touch panel or an operation key, so that it is possible to replace the toner cartridge with a simple operation on the display portion.

Further, according to an image forming apparatus of the present invention, an image forming apparatus includes a toner cartridge supporting apparatus that includes: a storage portion for storing a toner cartridge; an insertion port for inserting the toner cartridge in the storage portion; an opening/closing cover for covering the insertion port; a detecting portion for detecting a toner remaining amount in the toner cartridge stored in the storage portion; a control portion for controlling to supply a toner from the toner cartridge, and wherein the toner cartridge supporting apparatus described above is used, so that it is possible to confirm the toner cartridge which needs to be replaced easily and to seek to improve convenience the work of replacing the toner cartridge.

Further, according to a toner cartridge supporting method of the present invention, a toner cartridge supporting method includes: a step of detecting a toner remaining amount in a toner cartridge stored in a storage portion; a step of controlling to supply a toner from the toner cartridge; a step of judging whether or not the toner in the toner cartridge is exhausted based on a detection result of detecting the toner remaining amount in the toner cartridge; a step of generating a toner cartridge replacement message that notifies replacement of the toner cartridge based on a judgment result; a step of displaying the toner cartridge replacement message to be generated; a step of moving the toner cartridge from a toner supply position in the storage portion to an ejection position on a side of the insertion port; a step of displaying the replacement message by means of the display portion when it is judged that the toner in the toner cartridge is exhausted; and a step of moving the toner cartridge from the toner supply position to the ejection position when a user selects the replacement message displayed on the display portion, so that it is possible to confirm the toner cartridge which needs to be replaced easily and to seek to improve convenience of the work of replacing the toner cartridge.

DESCRIPTION OF THE PREFERRED EMBODIMENTS (First Embodiment)

Description will be hereinafter given for modes for carrying out the present invention with reference to drawings.

Figure 1:
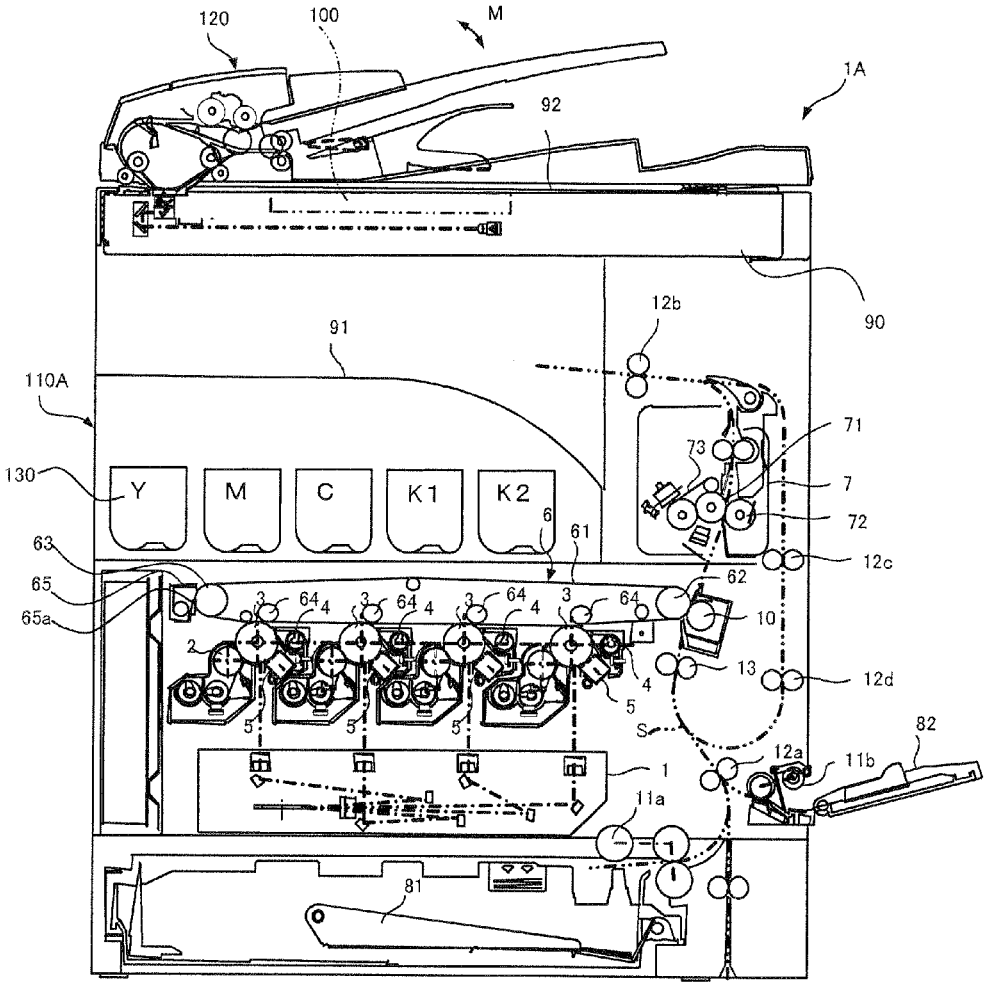
FIG. 1 is an illustrative view showing an entire configuration of an image forming apparatus according to an embodiment of the present invention.

FIG. 1 shows one example of the mode for carrying out the invention and is an illustrative view showing an entire configuration of an image forming apparatus according to a first embodiment of the present invention.

The present embodiment employs a configuration of a characteristic toner cartridge supporting apparatus according to the present invention as a toner cartridge supporting apparatus 200 in order to facilitate the work of replacing a toner cartridge 130 in an image forming apparatus 1A including the toner cartridge supporting apparatus 200 which is controlled to supply a toner from the toner cartridge 130 stored in the apparatus as shown in FIG. 1.

First, the entire configuration of the image forming apparatus 1A according to the present embodiment will be described.

As shown in FIG. 1, the image forming apparatus 1A is one that forms a multi-colored or monochrome image on a predetermined sheet of paper (for example, recording sheet of paper) depending on image data transmitted from outside, and is composed of a main apparatus body 110A and an automatic document processor 120.

The main apparatus body 110A is composed by including an exposure unit 1, a developing device 2, a photoreceptor drum 3, a cleaner unit 4, a charger 5, a transfer portion 6, a fixing unit 7, a paper feed cassette 81, a paper output tray 91 and the like.

Provided on the upper side of an image reading portion 90 provided in an upper part of the main apparatus body 110A is a platen glass (document table) 92 made of a transparent glass on which a document is placed, and on the upper side of the platen glass 92, the automatic document processor 120 is mounted.

The automatic document processor 120 automatically feeds documents onto the platen glass 92.

In addition, the automatic document processor 120 is configured so as to rotate freely in the direction of an arrow M so that a document is able to be placed by hands by opening the top of the platen glass 92.

Image data handled in the image forming apparatus 1A is data corresponding to color images using respective colors of black (K), cyan (C), magenta (M) and yellow (Y).

Accordingly, four sets of the developing device 2, the photoreceptor drum 3, the charger 5, and the cleaner unit 4 are provided and assigned to black, cyan, magenta, and yellow, respectively, so as to form four kinds of latent images corresponding to the respective colors, which constitute four image stations.

The charger 5 is a charging portion for charging the surface of the photoreceptor drum 3 uniformly with a predetermined electrical potential, and may use a contact-type charger, a roller-type charger or a brush-type charger, other than the charger type shown in FIG. 1.

The exposure unit 1 is an image writing device that illuminates the charged photoreceptor drums 3 with light in accordance with image data input from the outside or image data obtained by reading from a document so as to form an electrostatic latent image corresponding to the image data on the surfaces of the photoreceptor drums 3, and is configured as an LSU (laser scanning unit) including a laser emitting portion, a reflection mirror, and the like. Moreover, in the exposure unit 1, a polygon mirror for scanning a laser beam, optical elements such as lenses and mirrors for leading the laser light reflected by the polygon mirror to the photoreceptor drums 3 are laid out.

In addition, as the exposure unit 1, methods using an array of light emitting elements such as an EL or LED writing head, for example, are also able to be used other than the configuration described above.

The thus configured exposure unit 1 has a function of illuminating each of the charged photoreceptor drums 3 with light in accordance with the input image data to form an electrostatic latent image corresponding to the image data on the surface of each photoreceptor drum 3.

The developing devices 2 visualize the electrostatic latent image formed on each photoreceptor drum 3 with four color (Y, M, C and K) toners.

The photoreceptor drums 3 have a cylindrical shape and are disposed over the exposure unit 1, and each surface thereof is cleaned by the cleaner unit 4 and the cleaned surface is uniformly charged by the charger 5.

The cleaner unit 4 removes and collects the toner remained on the surface of the photoreceptor drum 3 after development and image transfer.

The transfer portion 6 arranged over the photoreceptor drums 3 includes an endless intermediate transfer belt (endless belt) 61, an intermediate transfer belt drive roller 62, an intermediate transfer belt driven roller 63, intermediate transfer rollers 64 and an intermediate transfer belt cleaning unit 65. Four intermediate transfer rollers 64 are provided corresponding to the respective colors of Y, M, C and K.

The intermediate transfer belt 61 is configured to be rotationally driven being supported by the intermediate transfer belt drive roller 62, the intermediate transfer belt driven roller 63 and the intermediate transfer rollers 64.

The intermediate transfer belt 61 is formed in an endless shape using a film with about 100 μm to 150 μm thickness and is provided so as to contact with each photoreceptor drum 3. In addition, the intermediate transfer belt 61 has a function of sequentially transferring the toner images of the respective colors formed on the photoreceptor drums 3 in layers onto the intermediate transfer belt 61, thereby forming a color toner image (multi-colored toner image) on the intermediate transfer belt 61.

Transfer of the toner images from the photoreceptor drums 3 to the intermediate transfer belt 61 is performed by the intermediate transfer rollers 64 that are in contact with the rear side of the intermediate transfer belt 61.

Each intermediate transfer roller 64 is configured to give a transfer bias to the intermediate transfer belt 61 for transferring the toner image on the photoreceptor drum 3 onto the intermediate transfer belt 61. Specifically, a high-voltage transfer bias (high voltage of a polarity (+) opposite to the charging polarity (−) of the toner) is applied to the intermediate transfer roller 64 in order to transfer the toner image.

The intermediate transfer roller 64 is a roller that has a metal (for example, stainless steel) shaft with a diameter of 8 to 10 mm as a base with the surface thereof coated by a conductive elastic material (for example, EPDM, foamed urethane or the like). This conductive elastic material enables uniform application of a high voltage to the intermediate transfer belt 61. Note that, though the intermediate transfer rollers 64 in the shape of rollers are used as the transfer electrodes in the first embodiment, brushes and the like are also able be used instead of these rollers.

As described above, the visualized toner images corresponding to the respective color hues on each of the photoreceptor drums 3 are laid over on the intermediate transfer belt 61. The toner image formed as the laminated image information is conveyed with the intermediate transfer belt 61, moved to the contact position of the conveyed sheet of paper and the intermediate transfer belt 61 (secondary transfer position, predetermined position), and transferred to the sheet of paper by a transfer roller 10 arranged at this contact position.

At this time, the intermediate transfer belt 61 and the transfer roller 10 are put in press-contact with each other with a predetermined nip while a secondary transfer bias for transferring the toner image to the sheet of paper is applied to the transfer roller 10. This secondary transfer bias is a high voltage of a polarity (+) opposite to the charging polarity (−) of the toner.

Further, in order to constantly obtain the above predetermined nip, either the transfer roller 10 that is put in press-contact with the intermediate transfer belt 61 at the secondary transfer position or the intermediate transfer belt drive roller 62 that is put in press-contact with the rear side of the intermediate transfer belt 61 at the secondary transfer position is formed of a hard material (metal or the like) while the other is formed of a soft material such as an elastic roller or the like (elastic rubber roller, foamed resin roller or the like).

Since, in the above transfer step, the toner adhering to the intermediate transfer belt 61 as the belt comes into contact with the photoreceptor drums 3, or the toner which has not been transferred by the transfer roller 10 to the sheet of paper and remains on the intermediate transfer belt 61, causes color contamination of toners in the toner image formed at the next step, it is configured such that the toner is removed and collected by the intermediate transfer belt cleaning unit 65.

The intermediate transfer belt cleaning unit 65 is provided along the path in which the intermediate transfer belt 61 is conveyed and in the downstream side of the transfer roller 10 and in the upstream side of the photoreceptor drums 3 with respect to the conveyance direction of the intermediate transfer belt.

The intermediate transfer belt cleaning unit 65 includes a cleaning blade 65*a* as a cleaning member that contacts with the intermediate transfer belt 61 and cleans the surface of the intermediate transfer belt 61. The intermediate transfer belt 61 is supported from its rear side by the intermediate transfer belt driven roller 63, at the portion where the cleaning blade 65*a* contacts with the belt.

The paper feed cassette 81 is a tray for stacking the sheet of paper to be used for image formation and is provided under the exposure unit 1 of the main apparatus body 110A. In addition, a manual paper feed cassette 82 that permits the sheet of paper to be supplied from the outside is provided in the outside part of the main apparatus body 110A.

This manual paper feed cassette 82 is also able to be stacked with a plurality of sheets of paper to be used for image formation. Provided above the main apparatus body 110A is the paper output tray 91 that collects printed sheets of paper facedown.

Moreover, the main apparatus body 110A includes a paper feed path S that is in an approximately vertical shape to convey the sheet of paper from the paper feed cassette 81 or the manual paper feed cassette 82 to the paper output tray 91 by way of the transfer roller 10 and the fixing unit 7. Arranged near the paper feed path S from the paper feed cassette 81 or the manual paper feed cassette 82 to the paper output tray 91 are pickup rollers 11*a* and 11*b*, a plurality of feed rollers 12*a* to 12*d*, a registration roller 13, the transfer roller 10, the fixing unit 7 and the like.

The feed rollers 12*a* to 12*d* are small rollers for promoting and assisting conveyance of the sheet of paper and are provided along the paper feed path S. Note that, the feed roller 12*b* functions as a paper output roller for discharging the sheet of paper to the paper output tray 91, and is therefore called a paper output roller.

The pickup roller 11*a* is provided near the end portion of the paper feed cassette 81 so as to pick up the sheets of paper one by one from the paper feed cassette 81 to supply to the paper feed path S.

The Pickup roller 11*b* is provided near an end portion of the manual paper feed cassette 82 so as to pick up the sheets of paper one by one from the manual paper feed cassette 82 to supply to the paper feed path S.

The registration roller 13 is one that temporarily suspends the sheet of paper that is being conveyed on the paper feed path S. In addition, this roller has a function of conveying the sheet of paper to the transfer roller 10 at such a timing that the front end of the sheet of paper meets the front end of the toner image on the photoreceptor drum 3. In other words, the toner image on the intermediate transfer belt 61 is adjusted by the registration roller 13 to be transferred to the predetermined position on the sheet of paper being conveyed.

The fixing unit 7 includes a pair of a heat roller 71 and a pressing roller 72 as fixing rollers 70, and the heat roller 71 and the pressing roller 72 are configured so as to rotate and convey the sheet of paper while holding it therebetween.

The heat roller 71 and the pressing roller 72 are arranged opposing to each other, forming a fixing nip portion at the position where the heat roller 71 and the pressing roller 72 are put in press-contact with each other.

The heat roller 71 is temperature-controlled by a control portion (not shown) so as to be set at a predetermined fixing temperature. The control portion controls so that the surface temperature of the heat roller 71 is in the range of 160 to 200° C. based on a detection signal from a not-shown temperature detector (non-contact type thermistor) which is provided around the heat roller 71 and detects the temperature of the heat roller 71.

In addition, the heat roller 71 has a function of thermally pressing the toner to the sheet of paper in cooperation with the pressing roller 72, so as to thermally fix the multi-colored toner image transferred on the sheet of paper by fusing, mixing and pressing it. Moreover, the heat roller 71 includes an external heating belt 73 for fixing the heat roller 71 from the outside, as shown in FIG. 1.

On the other hand, similarly to the heat roller 71, the pressing roller 72 is also composed with an elastic layer formed on the peripheral surface of a cylindrical metal core. Moreover, the pressing roller 72 is configured so as to abut the heat roller 71 with a predetermined pressure.

Further, the image forming apparatus 1A is connected to a PC, a FAX, and a data management server of a manufacturer, a sales destination, a lease destination or the like through a not-shown network line (such as LAN or telephone line).

Here, a characteristic configuration of the image forming apparatus 1A of the present embodiment will be described with reference to the block diagrams.

Figure 2:
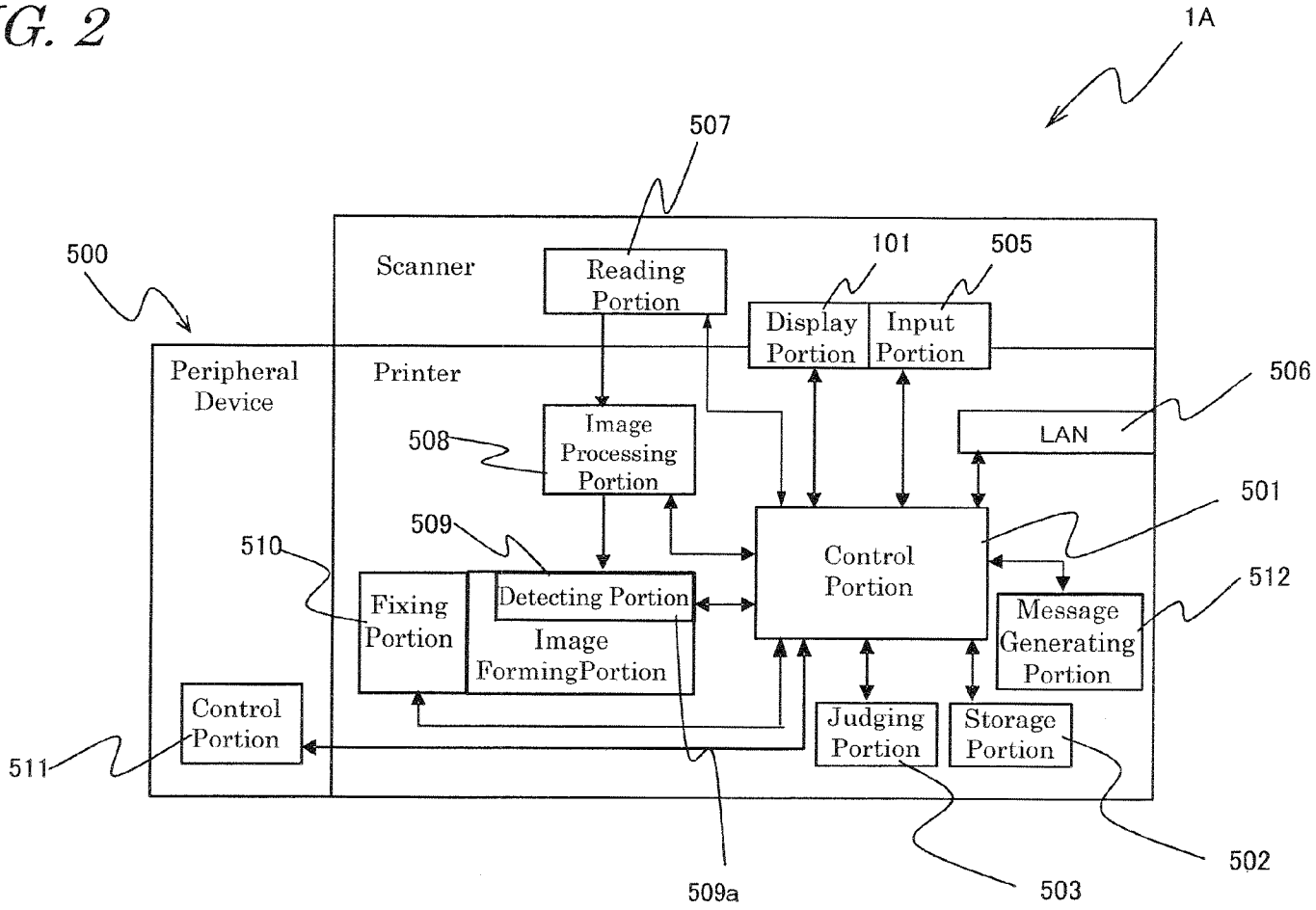
FIG. 2 is a block diagram showing a configuration of the above image forming apparatus.
Figure 3:
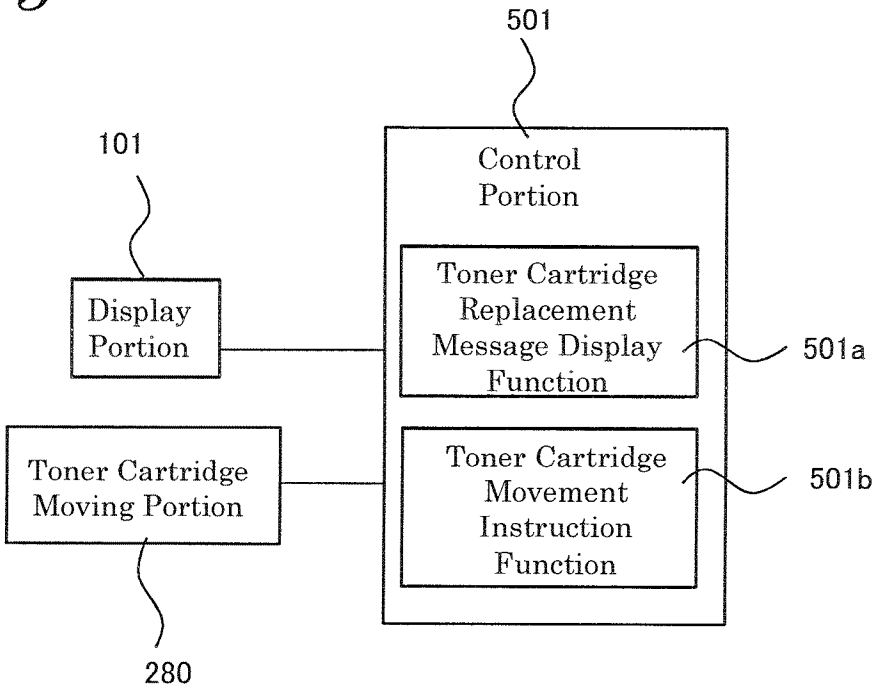
FIG. 3 is a block diagram showing a configuration of a control portion of the above image forming apparatus.

FIG. 2 is a block diagram showing a configuration of the image forming apparatus of the present embodiment, and FIG. 3 is a block diagram showing a configuration of a control portion of the above image forming apparatus.

As shown in FIG. 2, the image forming apparatus 1A includes, as an electrical configuration, a control portion 501 for controlling operations of the image forming apparatus 1A, a storage portion (storage portion) 502, a judging portion (judging portion) 503, a display portion 101, an input portion 505, a communication portion 506 for performing LAN connection and the like with a PC and the like through a network line, an image processing portion 508 for performing image processing, an image forming portion 509 for performing image formation, a fixing portion 510 for performing fixing processing of a toner image, a reading portion 507 for reading an image by a scanner, a control portion 511 for controlling operations of a post-processing apparatus 500 (referring to a peripheral device of FIG. 2), and the like.

In addition, the image forming apparatus 1A includes a detecting portion 509*a* for detecting the storage portion of the stored toner cartridge 130 or information stored in the storage portion. The detecting portion 509*a* detects information of the toner cartridge 130 used by a user in the image forming apparatus 1A.

Further, the image forming apparatus 1A includes a message generating portion (message generating portion) 512 for generating a toner cartridge replacement message to notify that the toner cartridge 130 is to be replaced.

The toner cartridge replacement message and a toner cartridge replacement program are stored in the storage portion 502.

The toner cartridge replacement program is a program for displaying an icon as a switch to instruct replacement of the toner cartridge.

The judging portion 503 judges whether or not the toner in the toner cartridge 130 is exhausted based on a detection result (remaining amount of the toner) detected by the detecting portion 509*a*.

The message generating portion 512, when the judging portion 503 judges that the toner in the toner cartridge is exhausted, generates the toner cartridge replacement message and the toner cartridge replacement program stored in the storage portion 502.

As shown in FIG. 3, the control portion 501 has a toner cartridge replacement message display function 501*a* of causing the display portion 101 to display the toner cartridge replacement message when the judging portion 503 judges that the toner in the toner cartridge 130 is exhausted, and a toner cartridge movement instruction function 501*b* of instructing a toner cartridge moving portion 280 to move the toner cartridge 130 from a toner supply position to an ejection position when the user selects the toner cartridge replacement message displayed on the display portion 101.

That is, the control portion 501 is configured, when it becomes necessary to replace the toner cartridge 130, to read out, with the toner cartridge replacement message display function 501*a*, the message and the toner cartridge replacement program stored in the storage portion 502 by the message generating portion 512 and display the toner cartridge replacement message and the icon to instruct replacement of the toner cartridge on the display portion 101. It is configured such that the toner cartridge 130 is moved to a position where the cartridge is easily ejected by the toner cartridge moving portion 280.

Next, description will be given for the characteristic toner cartridge supporting apparatus 200 used for the image forming apparatus 1A of the present embodiment with reference to the drawings.

Figure 4A:
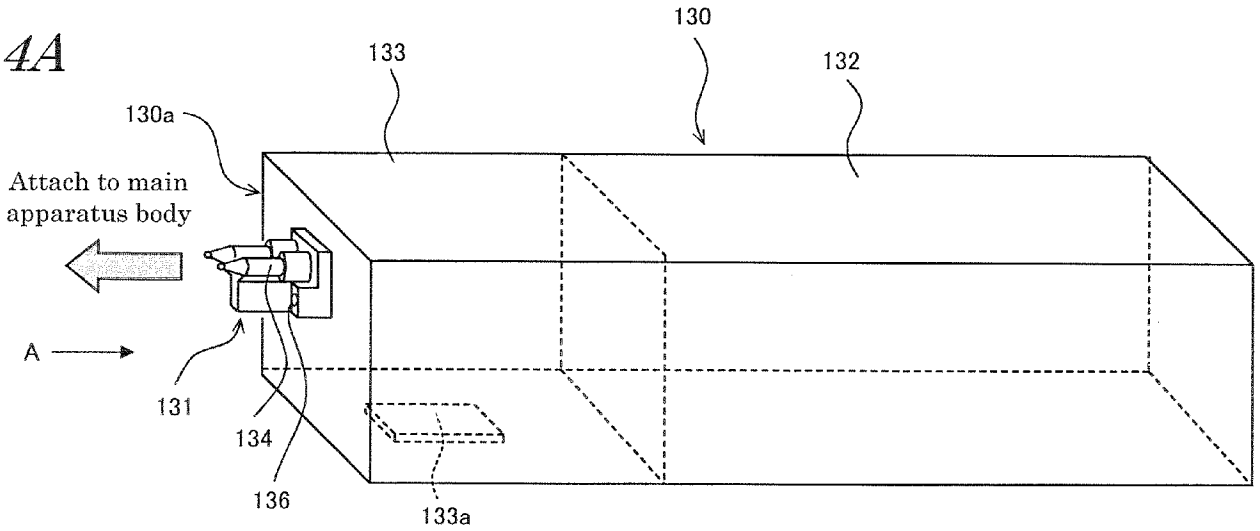
FIG. 4A is an illustrative view showing a configuration of a toner cartridge mounted on the above image forming apparatus.
Figure 4B:
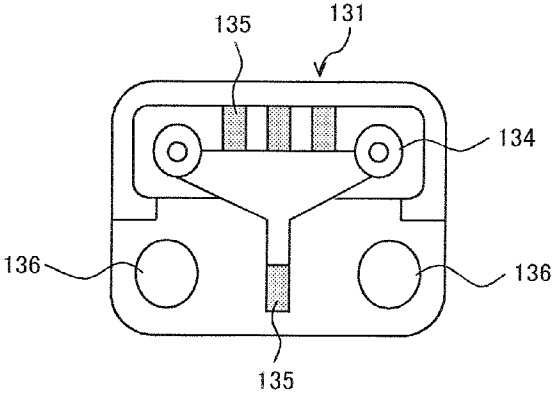
FIG. 4B is a perspective view along an arrow A of FIG. 4A.
Figure 5:
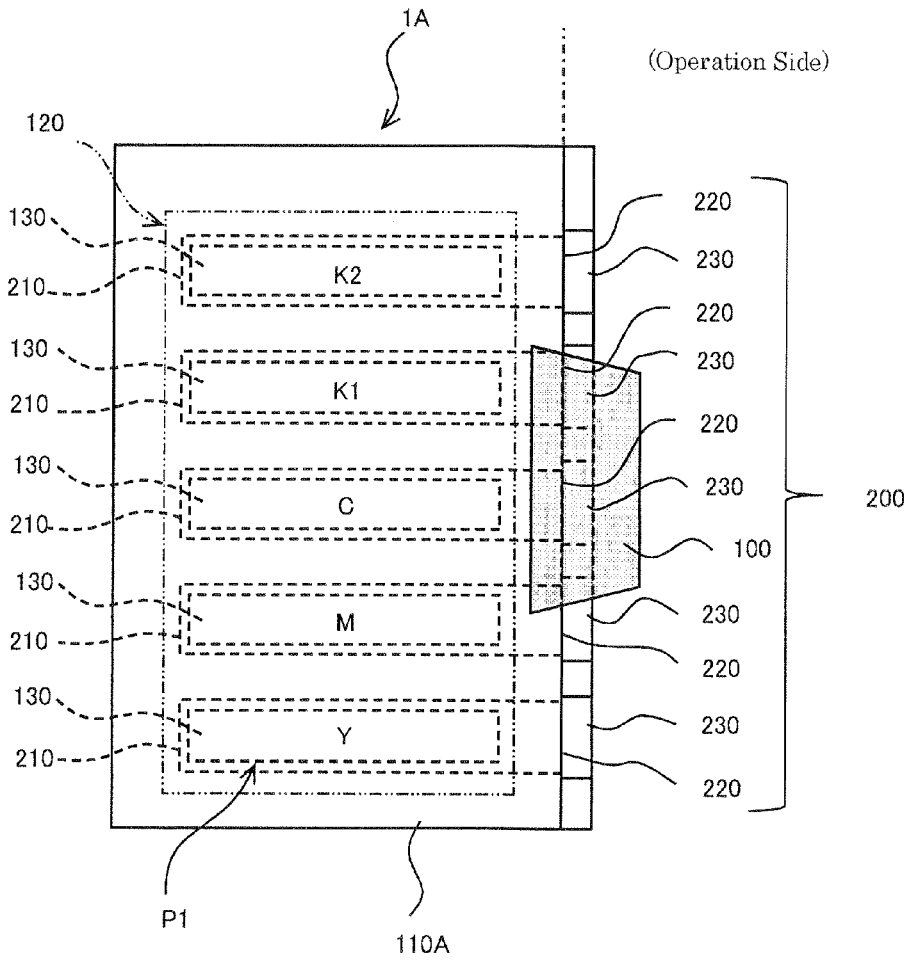
FIG. 5 is an illustrative view showing a configuration of a toner cartridge supporting apparatus of the present embodiment in plan view.
Figure 6:
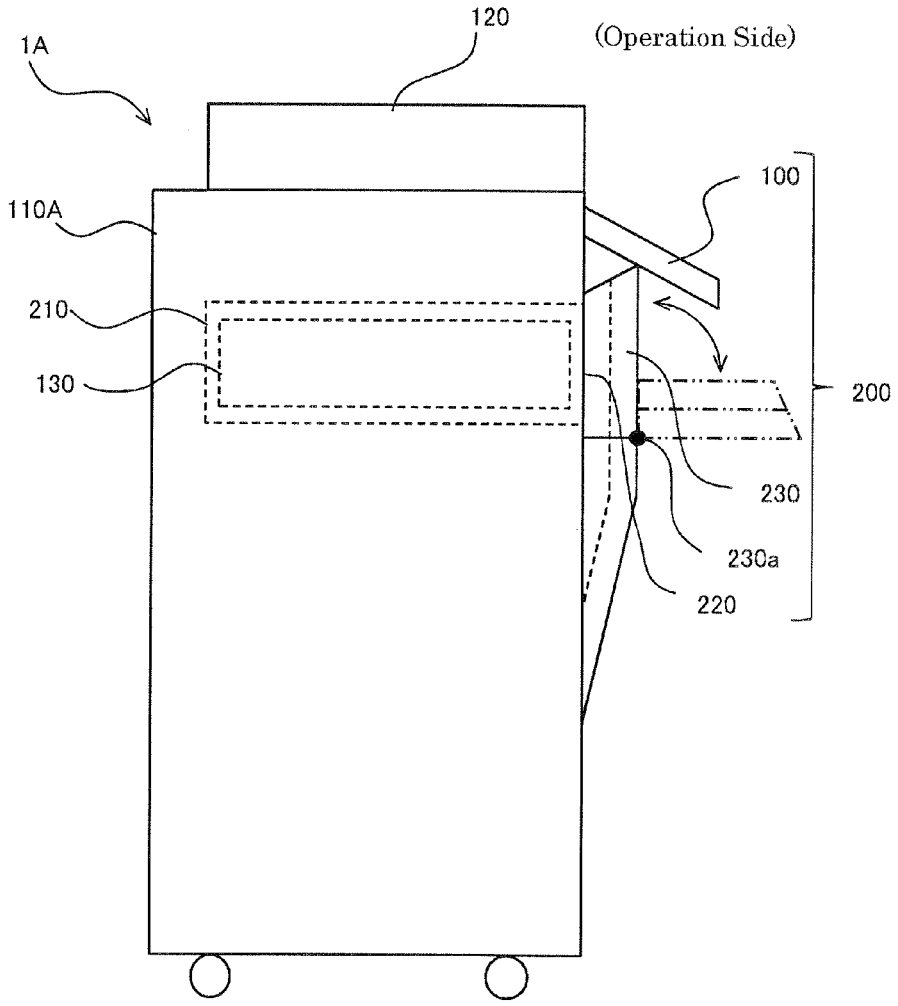
FIG. 6 is an illustrative view showing a configuration of the above toner cartridge supporting apparatus in side view.
Figure 7:
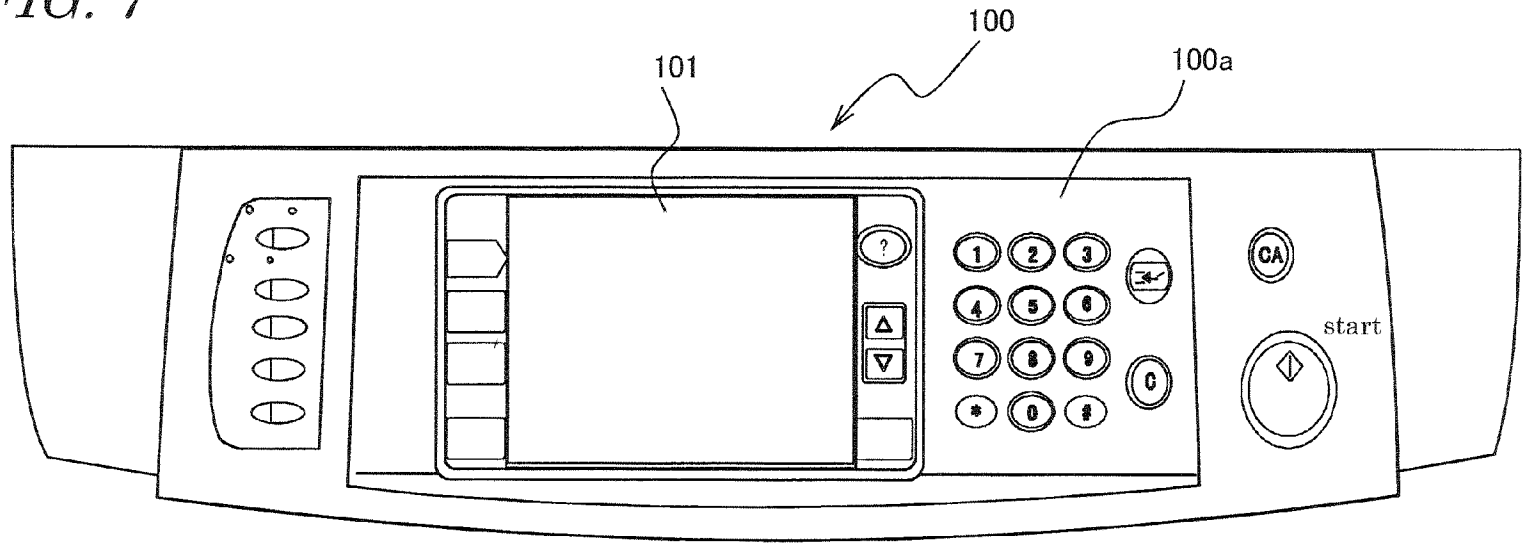
FIG. 7 is an illustrative view showing a configuration of an operation panel constituting the above toner cartridge supporting apparatus.
Figure 8:
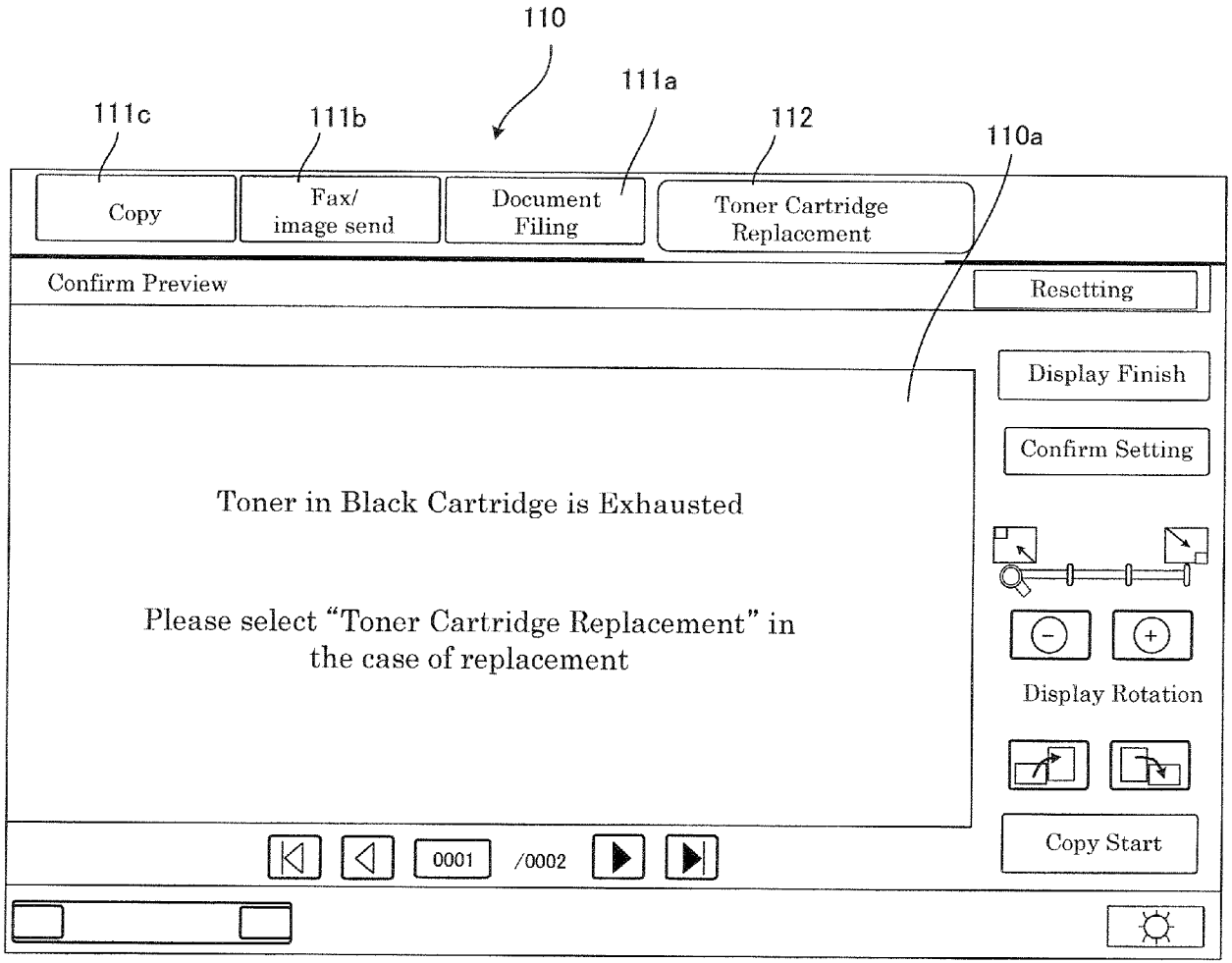
FIG. 8 is an illustrative view showing an example of display of a message about toner cartridge replacement displayed on a display portion constituting the above operation panel.
Figure 9:
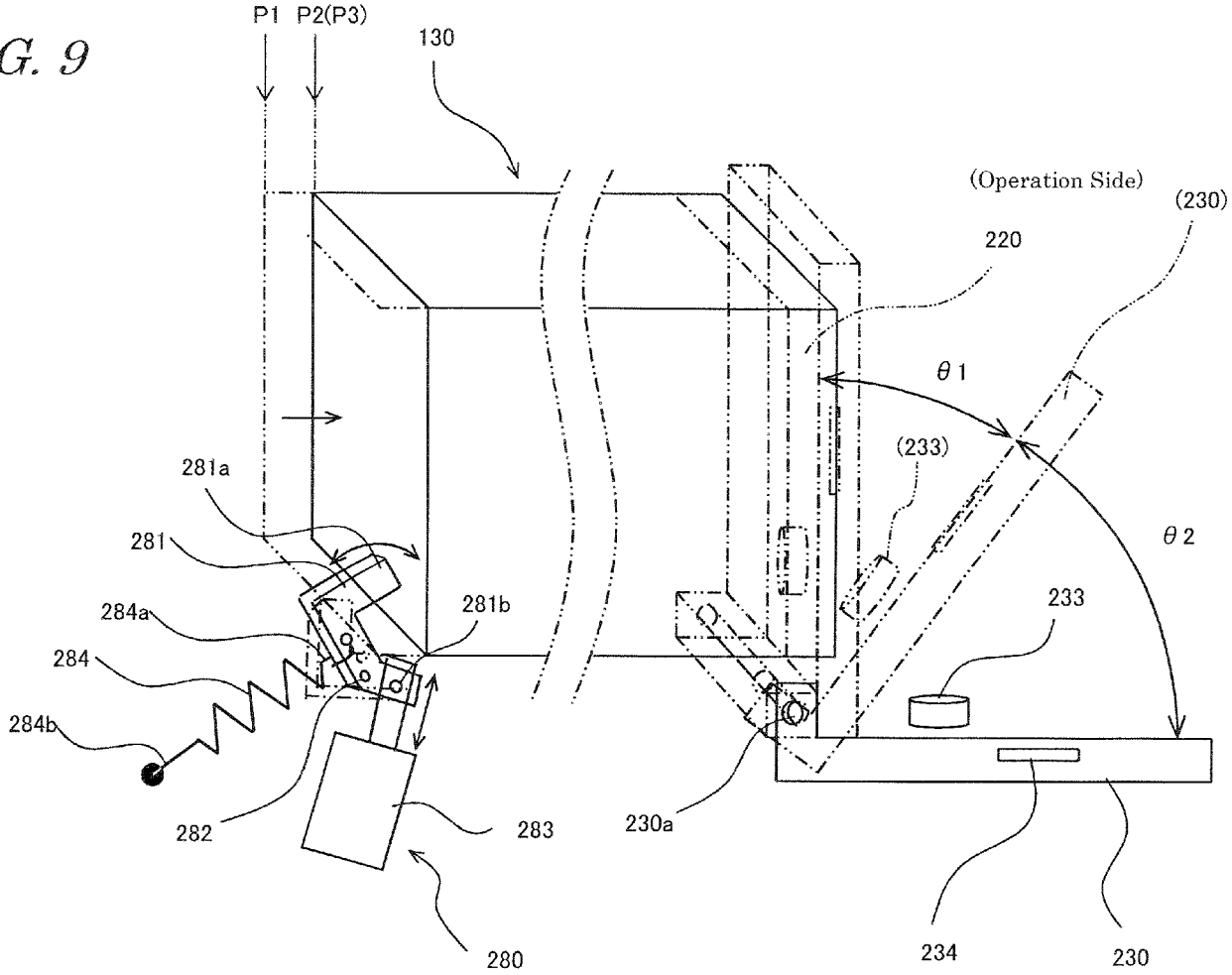
FIG. 9 is an illustrative view showing a configuration of a toner cartridge moving portion and an opening/closing cover constituting the above toner cartridge supporting apparatus.
Figure 10:
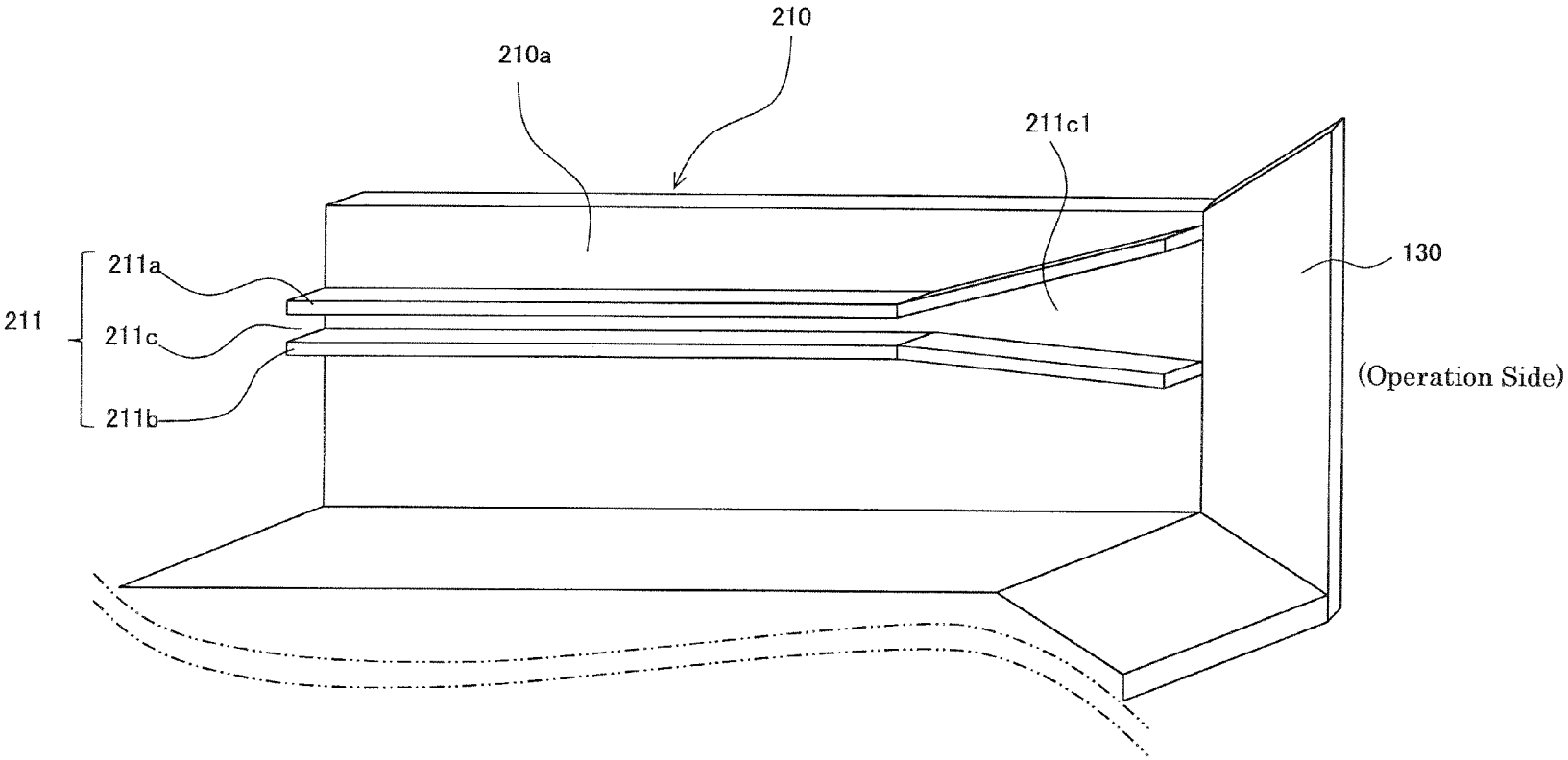
FIG. 10 is an illustrative view showing a configuration of a storage portion of a toner cartridge constituting the above toner cartridge supporting apparatus.
Figure 11:
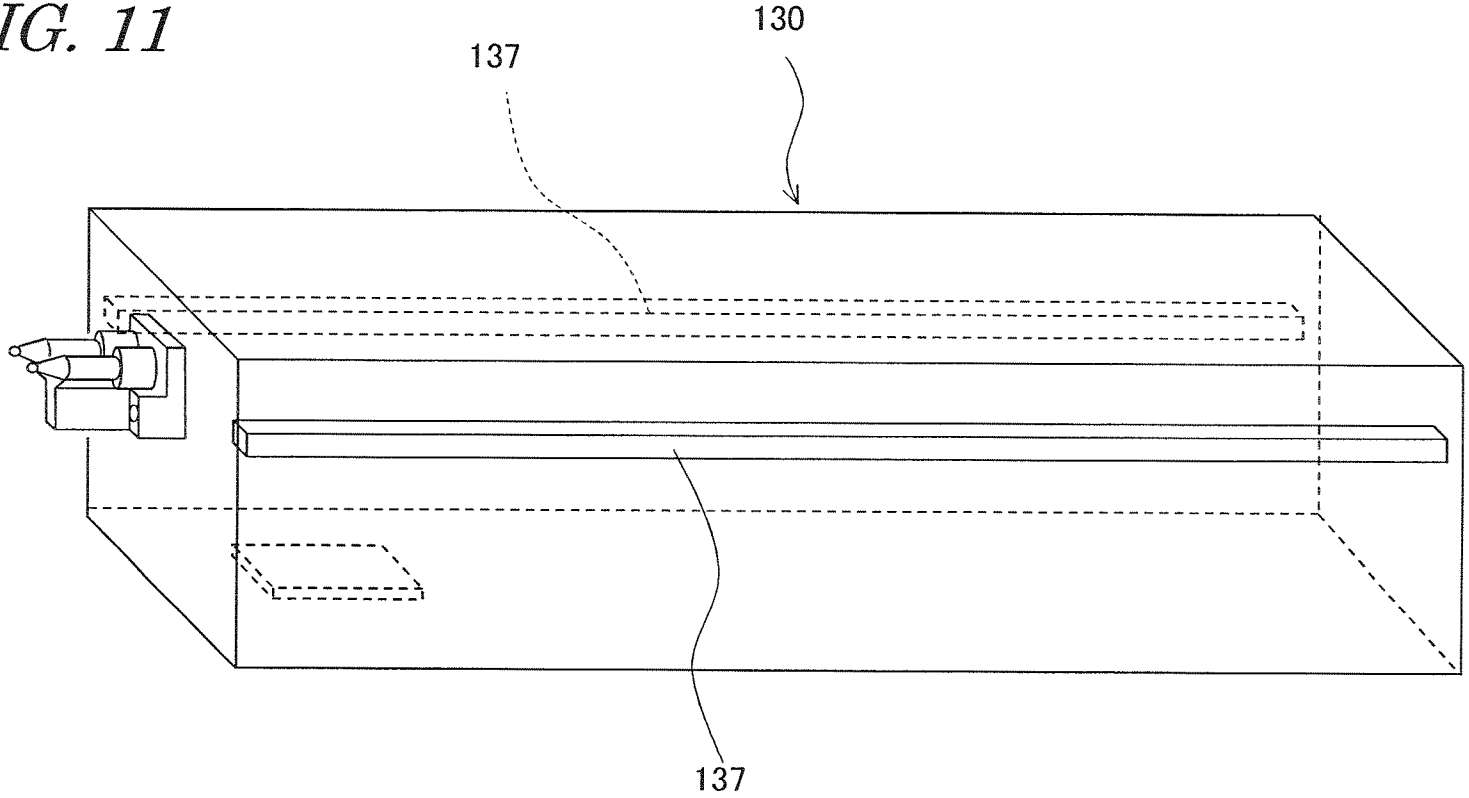
FIG. 11 is an illustrative view showing a configuration in which the above toner cartridge includes a rib.
Figure 12A:
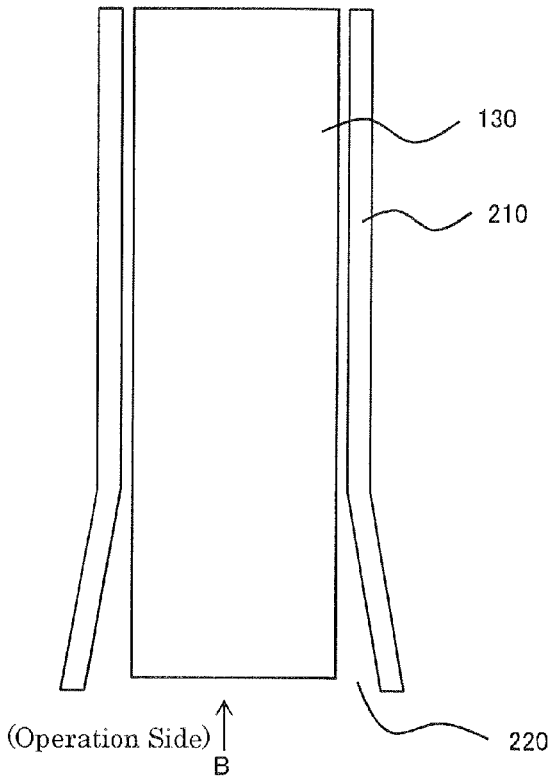
FIG. 12A is an illustrative view showing a shape of the above storage portion in plan view.
Figure 12B:
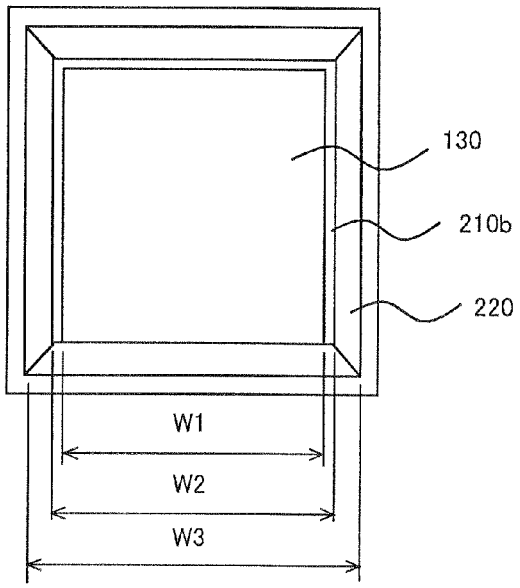
FIG. 12B is a perspective view along an arrow B of FIG. 12A.
Figure 13:
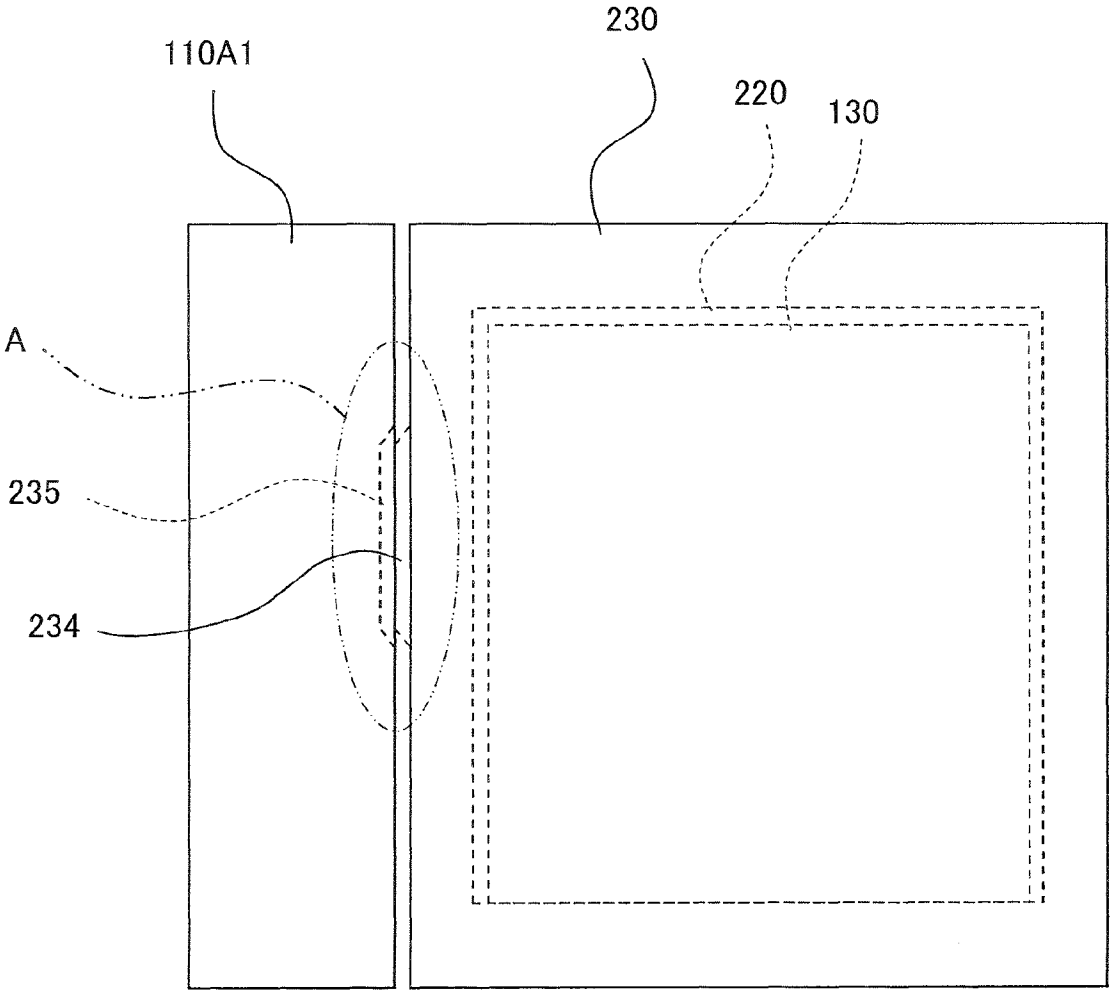
FIG. 13 is an illustrative view showing a lock configuration of the above opening/closing cover.
Figure 14A:
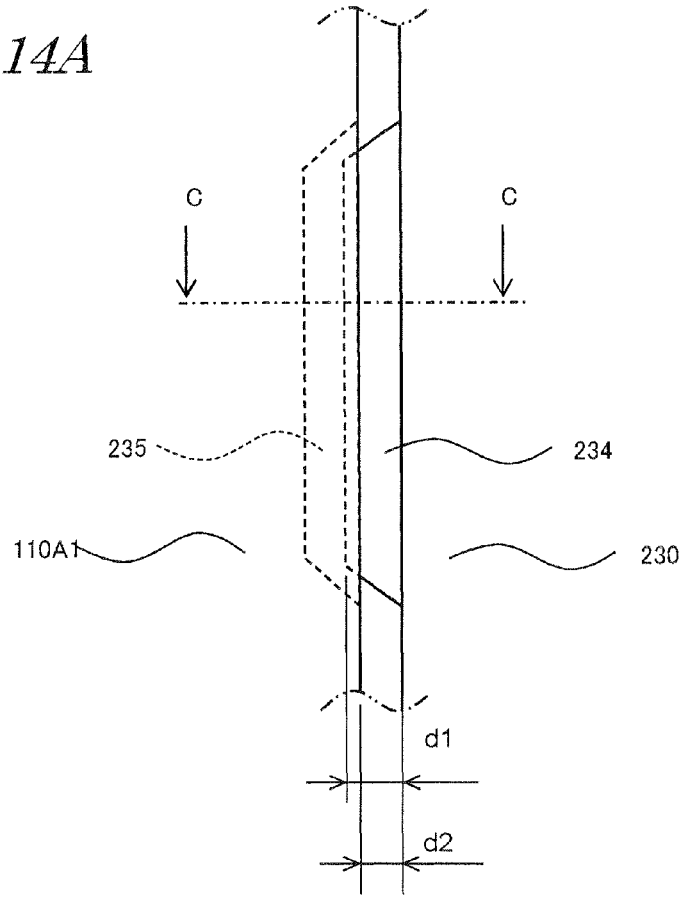
FIG. 14A is a detailed view of a portion C.
Figure 14B:
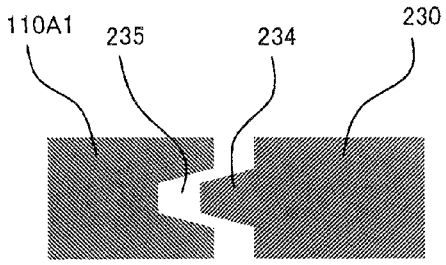
FIG. 14B is a sectional view cut along a plane C-C in FIG. 14A.
Figure 15:
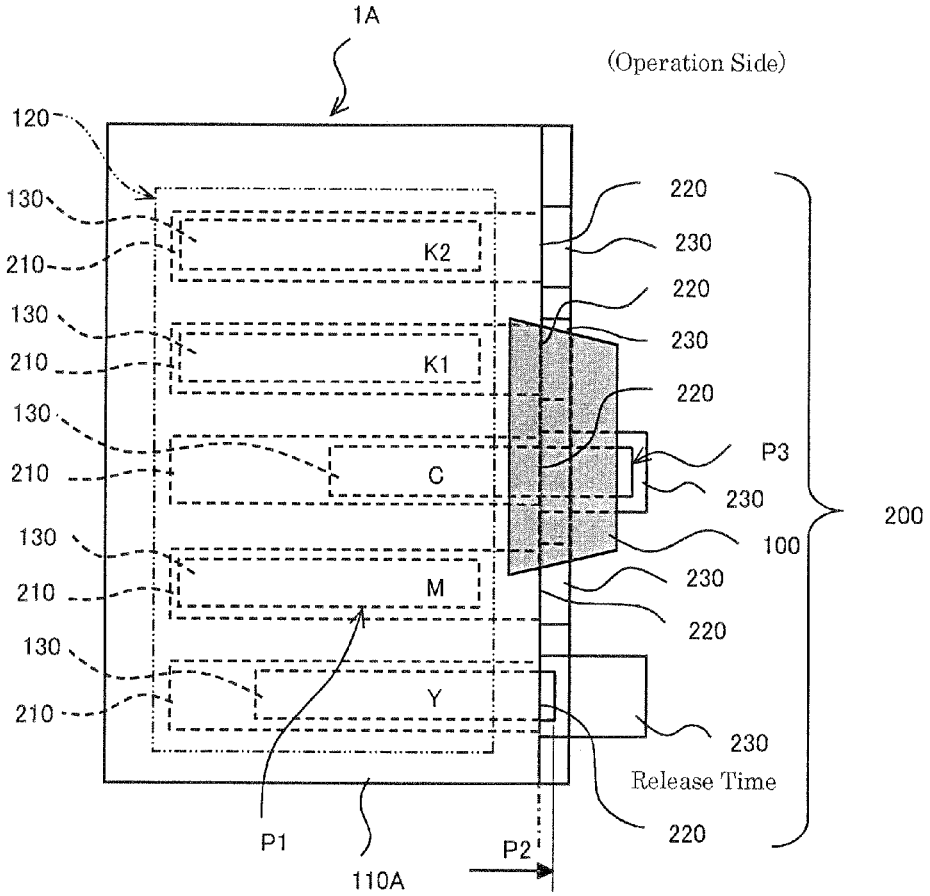
FIG. 15 is an illustrative view showing a state when a toner cartridge is ejected by the above toner cartridge supporting apparatus in plan view.
Figure 16:
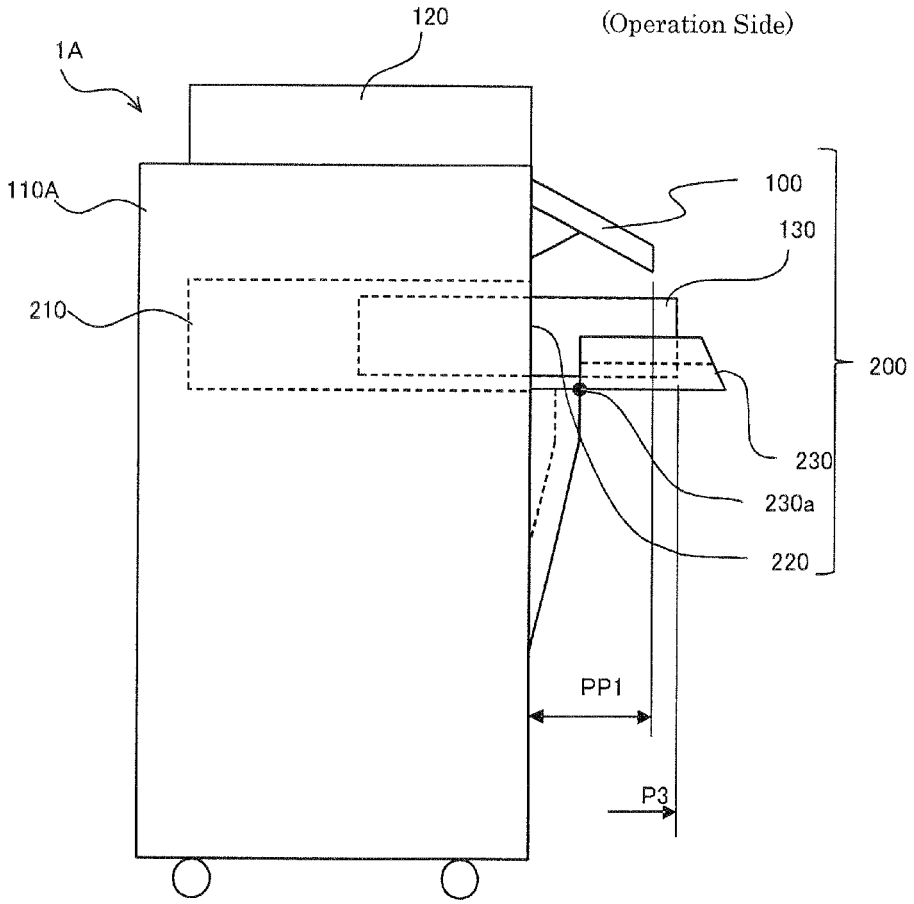
FIG. 16 is an illustrative view showing a state when a toner cartridge is ejected by the above toner cartridge supporting apparatus in side view.

FIG. 4A is an illustrative view showing a configuration of a toner cartridge mounted on the image forming apparatus of the present embodiment, FIG. 4B is a perspective view along an arrow A of FIG. 4A, FIG. 5 is an illustrative view showing a configuration of the toner cartridge supporting apparatus of the present embodiment in plan view, FIG. 6 is an illustrative view showing a configuration of the above toner cartridge supporting apparatus in side view, FIG. 7 is an illustrative view showing a configuration of an operation panel constituting the above toner cartridge supporting apparatus, FIG. 8 is an illustrative view showing an example of display of a message about toner cartridge replacement displayed on a display portion constituting the above operation panel, FIG. 9 is an illustrative view showing a configuration of a toner cartridge moving portion and an opening/closing cover constituting the above toner cartridge supporting apparatus, FIG. 10 is an illustrative view showing a configuration of a storage portion of a toner cartridge constituting the above toner cartridge supporting apparatus, FIG. 11 is an illustrative view showing a configuration in which the above toner cartridge includes a rib, FIG. 12A is an illustrative view showing a shape of the above storage portion in plan view, FIG. 12B is a perspective view along an arrow B of FIG. 12A, FIG. 13 is an illustrative view showing a lock configuration of the above opening/closing cover, FIG. 14A is a detailed view of a portion C, FIG. 14B is a sectional view cut along a plane C-C in FIG. 14A, FIG. 15 is an illustrative view showing a state when a toner cartridge is ejected by the above toner cartridge supporting apparatus in plan view, and FIG. 16 is an illustrative view showing a state when a toner cartridge is ejected by the above toner cartridge supporting apparatus in side view.

First, description will be given for the toner cartridge 130 used for the image forming apparatus 1A.

As shown in FIG. 4A and FIG. 4B, the toner cartridge 130 is comprised of a columnar body having an approximately rectangular cross section, and includes a toner storage portion 132 in which a supply toner is stored and a waste toner collecting portion 133 in which a waste toner is collected.

Provided on the bottom part (lower side in the figure) of the waste toner collecting portion 133 is a waste toner collecting port 133*a*. At one end portion 130*a* of the toner cartridge 130 which is attached toward the main body of the image forming apparatus 1A, a storage portion (storage portion) 131 in which consumables information is stored is provided.

The storage portion 131 is configured using any one of an IC chip (for example, a non-volatile memory such as a wireless IC tag or a contact-type CRUM), a bar code, and a two-dimensional code such as a QR code (registered trademark). In the present embodiment, the storage portion 131 includes a contact-type CRUM of a non-volatile memory comprised of a device embedded with an EEPROM or the like for storing information about the toner cartridge and the like, and information of a model number, a manufactured place, a toner remaining amount (which is updated sequentially) of the toner cartridge, whether or not the toner cartridge is new, and the like is stored in this memory.

The storage portion 131 includes a storage portion positioning boss 134. The storage portion positioning boss 134 is a positioning member for positioning the storage portion 131 with respect to a storage portion connector (not shown) on the main body side of the image forming apparatus 1A when the toner cartridge 130 is attached to the image forming apparatus 1A. In the figure, the reference numeral 135 denotes a connection terminal, 136 denotes an attachment hole for attaching the storage portion 131 to the toner cartridge 130.

As shown in FIG. 5 and FIG. 6, the toner cartridge supporting apparatus 200 of the present embodiment includes a storage portion 210 for storing the toner cartridge 130, an insertion port 220 through which the toner cartridge 130 is inserted in the storage portion 210, and an opening/closing cover 230 for covering the insertion port 220.

As shown in FIG. 2, the toner cartridge supporting apparatus 200 further includes the judging portion 503 to judge whether or not the toner in the toner cartridge 130 is exhausted based on a detection result by the detecting portion 509*a* which detects a toner remaining amount in the toner cartridge 130 stored in the storage portion 210, the message generating portion 512 for generating a toner cartridge replacement message to notify that the toner cartridge 130 is to be replaced based on a judgment result by the judging portion 503, and the display portion 101 for displaying the toner cartridge replacement message generated by the message generating portion 512.

In the present embodiment, the display portion 101 of an operation panel 100 is configured so as to function as a display portion of the toner cartridge supporting apparatus 200. As shown in FIG. 5 and FIG. 6, the operation panel 100 is provided to be projected to the operation side of the image forming apparatus 1A.

As shown in FIG. 7, the operation panel 100 has an operation surface (input portion) 100*a* formed in an approximately plane shape and the display portion 101 formed on an approximately center part thereof.

Note that, the display portion 101 may not be on the same plane with the operation surface (input portion) 100*a* but may be in an opening/closing movement type with respect to the operation surface (input portion) 100*a* or may be provided separately from the operation surface (input portion) 100*a*. In addition, the display portion 101 may be provided in the combined manner thereof.

The display portion 101 further includes a touch panel or an operation key approximately integrally, and is configured such that the display portion 101 functions as the input portion 505 by operating the touch panel or the operation key on the display portion 101.

As shown in FIG. 8, an operation key 110 for selecting a processing mode by the image forming apparatus 1A is displayed on the display portion 101. In the operation key 110, an icon for a DOCUMENT FILING mode 111*a*, an icon for an IMAGE SEND mode 111*b*, and an icon for a COPY mode 111*c* are provided. In addition, a toner cartridge replacement icon is provided (toner replacement instruction portion) 112 that is displayed when the toner of the toner cartridge 130 is exhausted.

When the judging portion 503 judges that the toner in the toner cartridge 130 is exhausted as a result of detecting the toner remaining amount of the toner cartridge 130 by the detecting portion 509*a*, a toner cartridge replacement message 110*a* for notifying that the toner of the toner cartridge 130 is exhausted is displayed, and the toner cartridge replacement icon 112 is displayed on the display portion 101, as shown in FIG. 11.

In this manner, according to the present invention, when the toner of the toner cartridge 130 is exhausted in the image forming apparatus 1A, it is possible to inform the user that it is necessary to replace the toner cartridge 130, based on the toner cartridge replacement message 110*a* displayed on the display portion 101.

Further, as shown in FIG. 9, the toner cartridge supporting apparatus 200 includes the toner cartridge moving portion 280 for moving the toner cartridge 130 from a toner supply position P1 (shown in the two-dot chain line) in a storage portion (not shown) to an ejection position P2 (or P3) (shown in the solid line) when the toner cartridge is replaced.

As shown in FIG. 5 and FIG. 6, the storage portion 210 is configured such that the toner cartridge 130 is inserted approximately horizontally from one end portion in the longitudinal direction of the toner cartridge 130 from the operation side of the image forming apparatus 1A.

As shown in FIG. 10, a toner cartridge guide member 211 for guiding movement of the toner cartridge 130 may be provided on an inner wall portion 210*a* as an example of the storage portion 210.

The toner cartridge guide member 211 includes an upper-side guide portion 211*a* and a lower-side guide portion 211*b* which extend long along the longitudinal direction of the storage portion 210 with a predetermined space 211*c* in the vertical direction. The upper-side guide portion 211*a* and the lower-side guide portion 211*b* are configured such that space 211*c*1 becomes wider from the inner side of the storage portion 210 toward the insertion port 220 near the insertion port 220 on the operation side.

In the toner cartridge 130 used in this embodiment, as shown in FIG. 11, a rib 137 is formed to be projected long along the longitudinal direction at a part corresponding to the toner cartridge guide member 211 on the side surface thereof.

This configuration makes it possible to easily insert the toner cartridge 130 in the storage portion. 210 for conveyance.

As shown in FIG. 6, the insertion port 220 is formed on the side surface below the operation panel 100 on the operation side of the image forming apparatus 1A.

As an example of the insertion port 220, as shown in FIG. 12A and FIG. 123, the insertion port 220 has an open shape formed larger than a sectional shape of space of the storage portion 210. That is, in the present embodiment, when an open width of the toner cartridge 130 is W1, a width of an inner space 210*b* (inner wall portion 210*a*) of the storage portion 210 is W2, and an open width of the insertion port 220 is W3, the relation thereof is W1<W2<W3.

This configuration makes it possible to easily insert the toner cartridge 130 in the insertion port 220.

As shown in FIG. 6 and FIG. 9, the opening/closing cover 230 is configured so as to cover the insertion port 220 and is configured with a rotational fulcrum 230*a* arranged below the insertion port 220 so as to open the insertion port 220 by outwardly and downwardly rotating the upper end side of the opening/closing cover.

In addition, on the surface of the opening/closing cover 230 facing the insertion port 220, there is provided a convex guide member 233 for guiding an opening operation of the opening/closing cover 230 by contacting with the toner cartridge 130 when the toner cartridge 130 moves.

In the present embodiment, as shown in FIG. 9, when the toner cartridge 130 moves to abut the convex guide member 233, the opening/closing cover 230 is opened by an angle of θ1 from the approximately vertical state. Afterwards, the opening/closing cover 230 releases an angle of θ2 by its weight up to reaching the approximately horizontal state.

When the toner cartridge 130 is ejected from the storage portion 210 in a state where the opening/closing cover 230 is opened approximately horizontally, the convex guide member 233 guides the movement with the toner cartridge 130 mounted thereon.

In addition, as shown in FIG. 9 and FIG. 13, on the side surface of the opening/closing cover 230, a convex locking portion 234 is formed to be projected outward, and opening/closing cover lock is configured by the convex locking portion 234 and a concave locking portion 235 that is provided in a main body facing cover 110A1 provided adjacent to the opening/closing cover 230, which is corresponding to the convex locking portion 234.

As an example of the configuration of the opening/closing cover lock, as shown in FIG. 14A and FIG. 14B, it may be configured such that the convex locking portion 234 is formed in a tapered wedge shape and the concave locking portion 235 is formed in a concave shape in a manner that the convex locking portion 234 can be fitted with the concave locking portion 235.

Note that, in the present embodiment, as shown in FIG. 14, a size d1 of a projecting portion of the convex locking portion 234 is about 20.5 mm and a size d2 of space between the opening/closing cover 230 and the main body facing cover 110A1 is about 20 mm.

Accordingly, since the size d1 of the convex locking portion 234 is slightly larger than the size d2 of the space, and the convex locking portion 234 and the concave locking portion 235 are formed into the tapered wedge shape (tapered shape) to be fitted with each other, it is possible to realize smooth opening/closing operations of the opening/closing cover 230.

Note that, the opening/closing cover 230 may be provided at one position per one toner cartridge or may be provided at one position per two toner cartridges of K2 and black. They can be provided appropriately in seeking improvement of operability as needed.

As shown in FIG. 15, the toner cartridge moving portion 280 is configured, when the toner cartridge 130 is replaced, to move the toner cartridge 130 which needs to be replaced from the toner supply position P1 to the ejection position P2 (or P3).

The normal ejection position P2 of the toner cartridge 130 is arranged in a position of being projected on the operation side with respect to the operation side surface of the main apparatus body 110A.

The ejection position P3 of the toner cartridge 130 when the opening/closing cover 230 is arranged below the operation panel 100 is arranged in a position of being projected on the operation side with respect to an operation-side end portion PP1 of the operation panel 100 as shown in FIG. 16.

As an example of the configuration of the toner cartridge moving portion 280, as shown in FIG. 9, a pressing portion 281, a pressing portion rotational fulcrum pin 282, a solenoid 283, and a tension spring 284 are provided.

The pressing portion 281 has an approximately U-shape, and causes the toner cartridge 130 to abut a corner portion of one end side 281*a* in order to set a position at the toner supply position (shown in the two-dot chain line) and causes the toner cartridge 130 to move to the ejection position on the insertion port side (operation side) (shown in the solid line).

The pressing portion rotational fulcrum pin 282 axially supports the pressing portion 281 so as to be rotatable.

The solenoid 283 is engaged with the other end side 281*b* of the pressing portion 281 to rotate the pressing portion 281 around the pressing portion rotational fulcrum pin 282. The solenoid 283 is electrically connected to the control portion 501, and operations are controlled by the control portion 501.

The tension spring 284 restores the pressing portion 281 to a reference position (toner cartridge set position) by a spring force. One end side 284*a* of the tension spring 284 is coupled to the pressing portion 281 and the other end side 284*b* thereof is fixed to the main body side.

The pressing portion 281 is configured such that, when the other end side 281*b* is pulled by the solenoid 283, the one end side 281*a* rotates to extrude the toner cartridge 130 by a predetermined amount to the operation side. At this time, it is configured such that the opening/closing cover 230 is released by the toner cartridge 130 which has moved.

Here, description will be given for the replacement operation of the toner cartridge 130 by the toner cartridge supporting apparatus 200.

When replacement of the toner cartridge 130 whose toner is exhausted is instructed, the toner cartridge moving portion 280 operates to move the toner cartridge 130 to a position where the toner cartridge 130 is easily ejected with the toner cartridge movement instruction function 501*b* of the control portion 501.

In the pressing portion 281, as shown in FIG. 9, when the other end side 281*b* is pulled by the solenoid 283, the one end side 281*a* rotates in the clockwise direction about the pressing portion rotational fulcrum pin 282 fixed to the main body to extrude the toner cartridge 130 to the insertion port side.

Note that, normally (when it is not necessary to extrude the toner cartridge 130), the other end side 281*b* of the pressing portion 281 is tensioned by the tension spring 284, so that the pressing portion 281 waits in the state where the toner cartridge 130 is not pressed. In this state, the toner cartridge 130 can be arranged at the toner supply position P1.

The toner cartridge 130 extruded by the pressing portion 281, with the movement thereof, presses the convex guide member 233 provided in the opening/closing cover 230 to release the opening/closing cover 230, and a part of the toner cartridge 130 projects outward from the interior (storage portion 210) of the image forming apparatus 1A.

The user holds the part of the toner cartridge 130 to be projected with both hands to eject the toner cartridge 130 from the storage portion 210. This makes it possible to eject with both hands the toner cartridge having a size that is hard to be held with one hand.

Note that, based on the movement amount of the toner cartridge 130 by the toner cartridge moving portion 280, a protruding length of the toner cartridge can appropriately be set to in a manner as not to hinder visibility, corresponding to a size of the operation panel 100.

For example, as shown in FIG. 15, when the toner cartridge 130 of yellow (Y) is replaced, since there is nothing to hinder visibility of the user above the opening/closing cover 230, it is set in a manner as to project the toner cartridge 130 from the insertion port to the extent that the toner cartridge 130 is easily ejected.

On the other hand, when the toner cartridge 130 of cyan (C) is replaced, since there is the operation panel 100 which hinders visibility of the user above the opening/closing cover 230, it is set in a manner as to project the toner cartridge 130 from the insertion port to a position at which the toner cartridge 130 can be confirmed in plan view.

Next, description will be given for procedure for replacing the toner cartridge 130 by the toner cartridge supporting apparatus 200 of the image forming apparatus 1A with reference to the flowchart.

Figure 17:
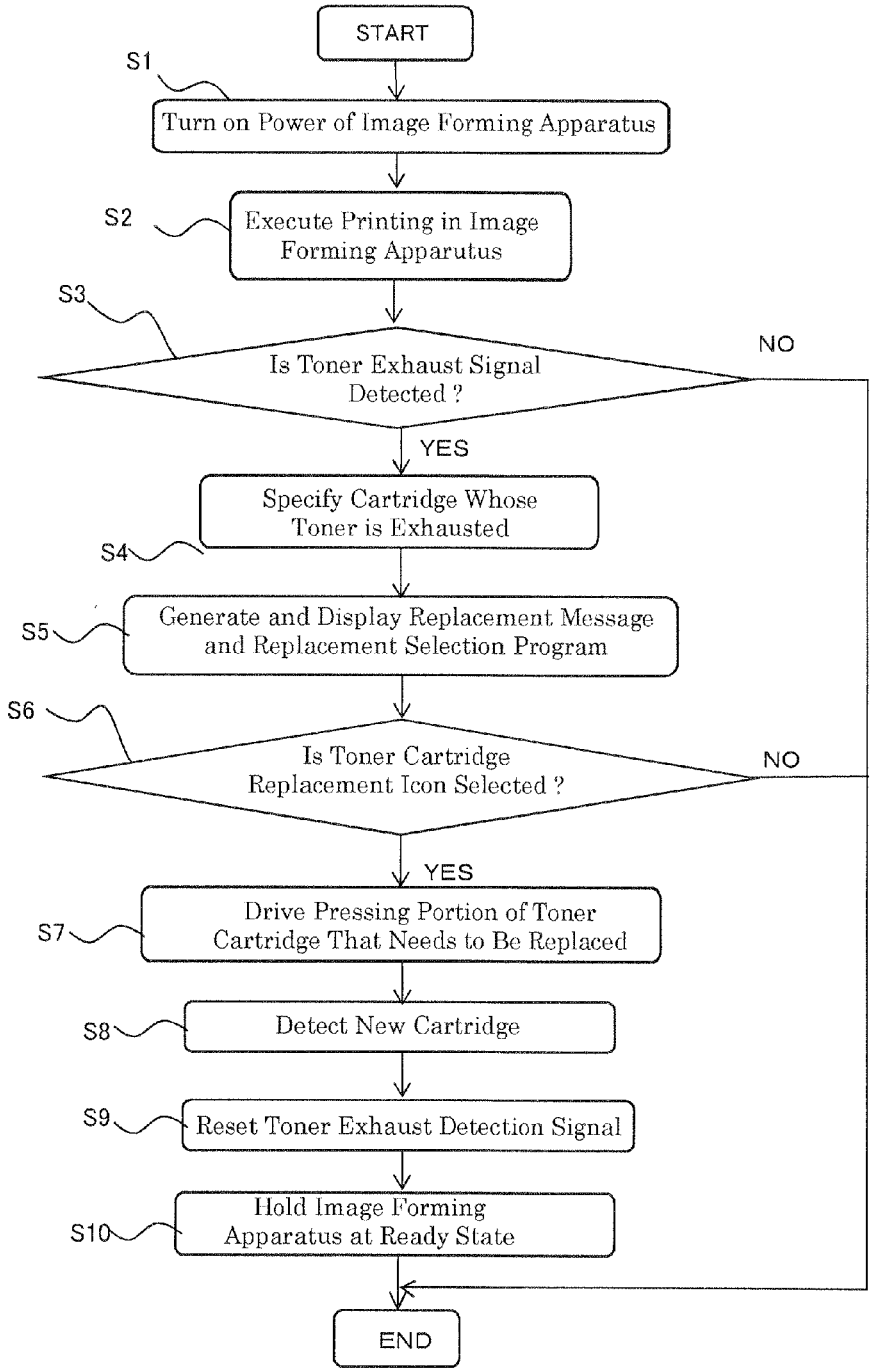
FIG. 17 is a flowchart showing procedure for replacing a toner cartridge by the above toner cartridge supporting apparatus.

FIG. 17 is a flowchart showing procedure for replacing the toner cartridge by the toner cartridge supporting apparatus of the image forming apparatus of the present embodiment.

As shown in FIG. 17, when power of the image forming apparatus 1A is turned on (step S1) to execute printing of the image forming apparatus 1A (step S2), the detecting portion 509*a* detects the toner remaining amount and the judging portion 503 judges whether or not the toner of the toner cartridge 130 is exhausted (step S3).

For example, the detecting portion 509*a* may be configured such that when the toner of the toner cartridge 130 is exhausted, and a not-shown switch is turned on, a signal is outputted so as to serve as a toner exhaust signal.

When the judging portion 503 judges that the toner of the toner cartridge 130 is not exhausted at step S3, the replacement processing of the toner cartridge 130 by the toner cartridge supporting apparatus 200 is completed.

On the other hand, at step S3, when the judging portion 503 judged that the toner of the toner cartridge 130 is exhausted, based on the detection result by the detecting portion 509*a* corresponding to any one of colors of the toner cartridge 130, the toner cartridge 130 whose toner is exhausted is specified (step S4).

Then, the message generating portion 512 reads and generates the toner cartridge replacement message and the toner cartridge replacement program stored in the storage portion 502, and as shown in FIG. 8, the toner cartridge replacement message 110*a* and the toner cartridge replacement icon 112 are displayed on the display portion 101.

Whether or not the toner cartridge replacement icon 112 is selected is then judged (step S6).

When it is judged that the toner cartridge replacement icon 112 is not selected at step S6, the replacement processing of the toner cartridge 130 by the toner cartridge supporting apparatus 200 is completed.

On the other hand, when it is judged that the toner cartridge replacement icon 112 is selected at step S6, the toner cartridge moving portion 280 of the toner cartridge 130 which needs to be replaced is operated to move the toner cartridge 130 to the ejection position P2 or the ejection position P3 (step S7).

In the present embodiment, when the toner cartridge 130 is moved to the ejection position by the toner cartridge moving portion 280, the opening/closing cover 230 is released, and the toner cartridge 130 goes outside, which the user can be confirm, so that it is possible to confirm easily which toner cartridge 130 is to be replaced.

Upon replacement to a new toner cartridge, then the detecting portion 509*a* detects that the new toner cartridge 130 is attached (step S8).

When it is confirmed that the new toner cartridge 130 is attached, the control portion 501 resets the toner exhaust signal detected by the detecting portion 509*a* (step S9), and holds the image forming apparatus 1A at a ready state (standby state) (step S10).

Then, the replacement processing of the toner cartridge 130 by the toner cartridge supporting apparatus 200 is completed.

As described above, according to the toner cartridge supporting apparatus 200 of the present embodiment, when the toner of the toner cartridge 130 attached to the image forming apparatus 1A is exhausted, the toner cartridge 130 is moved to the ejection position by the toner cartridge moving portion 280, and therefore the opening/closing cover 230 is released and the toner cartridge 130 is in the state of being projected from the storage portion 210, so that it is possible to confirm easily which toner cartridge 130 is to be replaced. In addition, it is possible to easily replace the toner cartridge 130.

(Second Embodiment)

Next, description will be given for a toner cartridge supporting apparatus of a second embodiment of the present invention with reference to the drawings.

Figure 18:
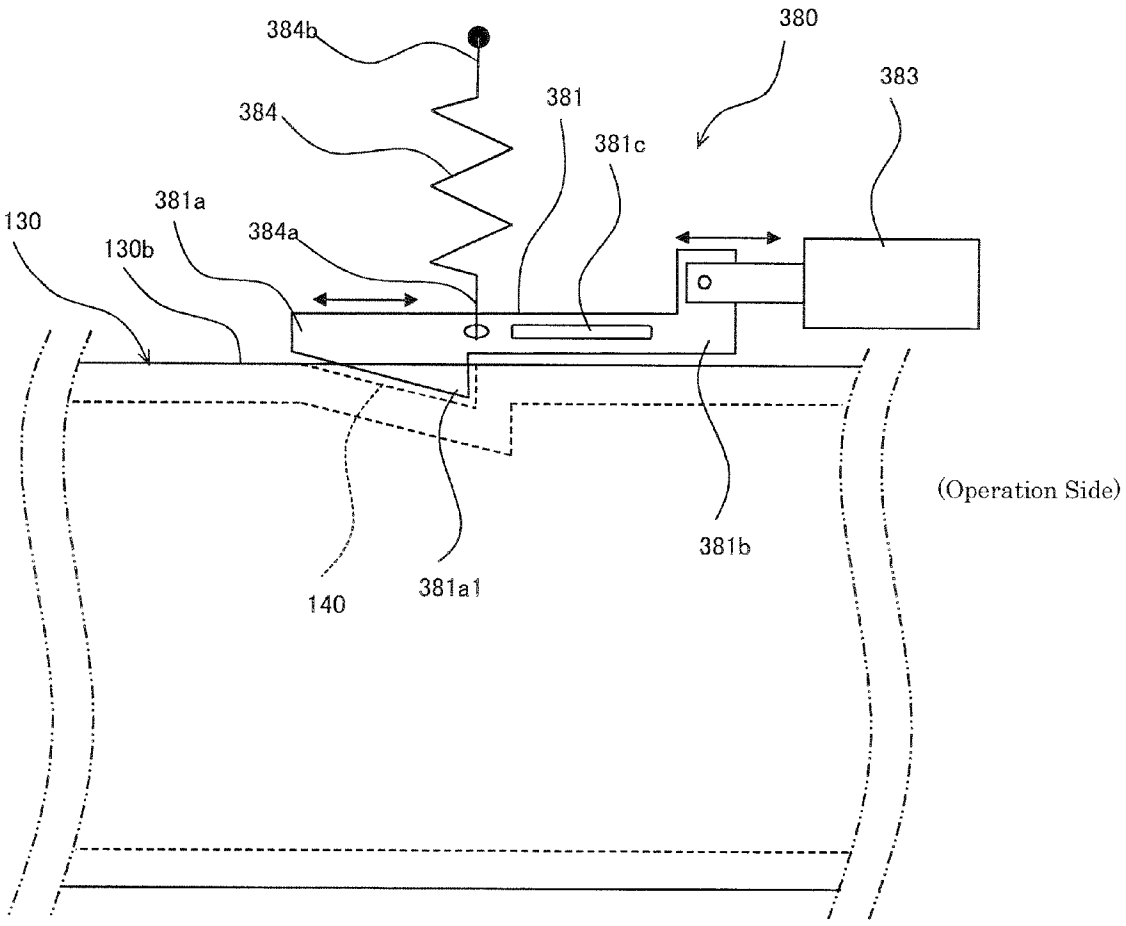
FIG. 18 is an illustrative view showing a configuration of a toner cartridge moving portion constituting a toner cartridge supporting apparatus of a second embodiment of the present invention.
Figure 19:
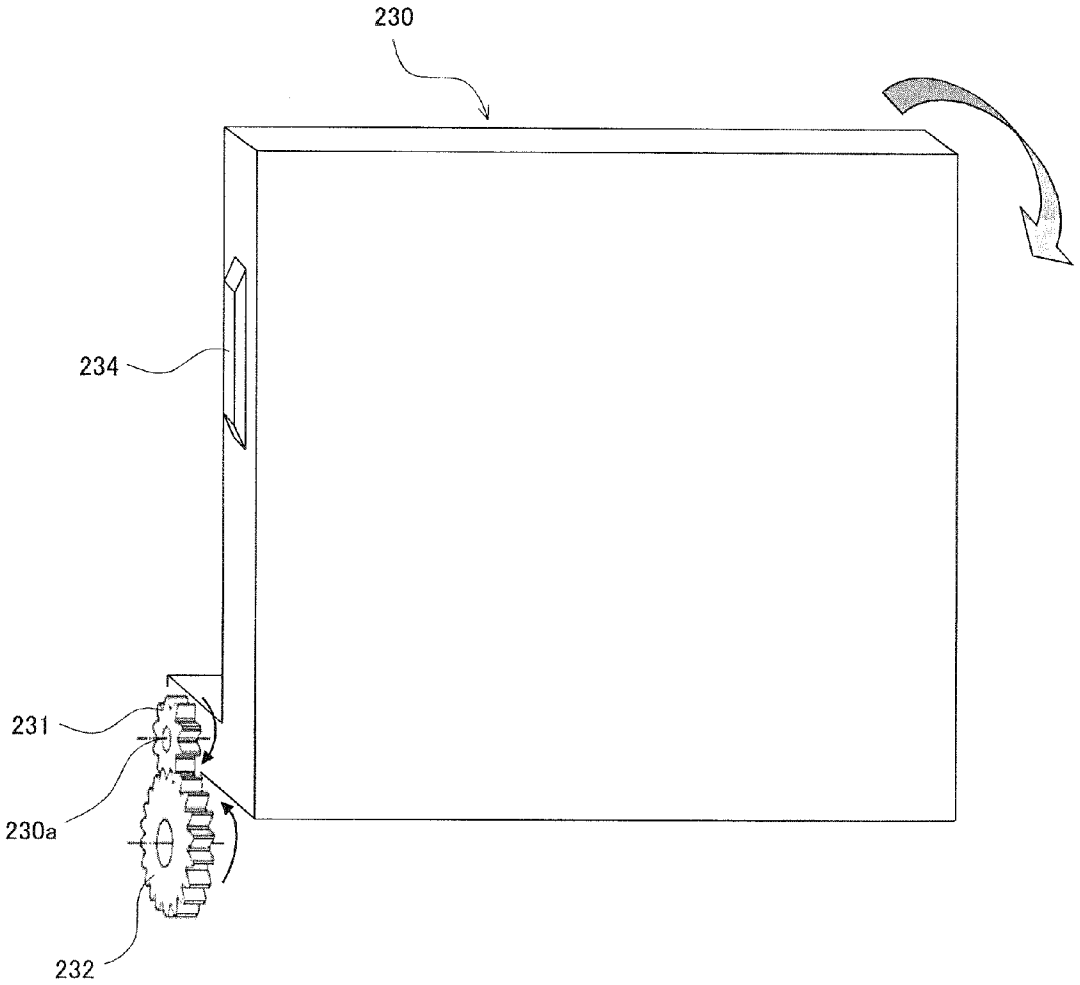
FIG. 19 is an illustrative view showing a configuration of the above opening/closing cover.

FIG. 18 is an illustrative view showing a configuration of a toner cartridge moving portion constituting the toner cartridge supporting apparatus according to the second embodiment of the present invention, and FIG. 19 is an illustrative view showing a configuration of the above opening/closing cover.

The second embodiment is characterized in that instead of the toner cartridge moving portion 280 of the first embodiment described above, a toner cartridge pulling portion 380 which pulls out the toner cartridge 130 from the storage portion 210 is provided, as shown in FIG. 18.

As shown in FIG. 15 and FIG. 16, the toner cartridge pulling portion 380 is configured to move the toner cartridge 130 which needs to be replaced from the toner supply position P1 to the ejection position P2 (or P3) when the toner cartridge 130 is replaced.

As shown in FIG. 18, the toner cartridge pulling portion 380 includes a pulling portion 381, a solenoid 383, and a pressing spring 384.

Provided on a top surface 130*b* of the toner cartridge 130 is a concave locking portion 140 which is recessed into a wedge shape corresponding to the pulling portion 381 of the toner cartridge pulling portion 380.

Specifically, provided on one end side 318*a* of the pulling portion 381 is an engagement portion 381*a*1 which is projected in a wedge shape to the toner cartridge 130 side from the interior of the storage portion 210 to the insertion port 220 side so that the toner cartridge 130 is movable from the interior of the storage portion 210 to the insertion port 220 side by hitching to the toner cartridge 130. A solenoid 383 is coupled at other end side 381*b*.

In addition, the pulling portion 381 is formed with a guide hole 381*c* long along the longitudinal direction (movement direction). The guide hole 381*c* guides the movement of the pulling portion 381 by a pin (not shown) fixed to the main body.

The convex locking portion 140 is formed to be recessed in a wedge shape so as to be engaged with the engagement portion 381*a* of the pulling portion 380.

The solenoid 383 is engaged with the other end side 381*b* of the pulling portion 381 to move the pulling portion 381 approximately horizontally. The solenoid 383 is electrically connected to the control portion 501 and operations thereof are controlled by the control portion 501.

The pressing spring 384 works in the direction pressing the pulling portion 381 against the top surface 130*b* of the toner cartridge 130 with the spring force. One end side 384*a* of the pressing spring 384 is coupled to the pulling portion 381 and the other end side 384*b* is fixed to the main body side.

In addition, as the configuration of the opening/closing cover 230, as shown in FIG. 19, a gear may be used as an opening portion for opening/closing the opening/closing cover 230.

When the gear is used as the opening portion of the opening/closing cover 230, for example, as shown in FIG. 19, a first gear 231 is integrally provided with the rotational fulcrum 230*a* of the opening/closing cover 230. In the lower side of the opening/closing cover 230, a second gear 232 which is engaged with the first gear 231 is provided in the main apparatus body side (not shown). The second gear 232 rotates by a not-shown rotational drive portion (drive motor).

When the opening/closing cover 230 is opened using the rotational drive portion, the first gear 231 is rotated in the clockwise direction. When the opening/closing cover 230 is closed, for example, it may be configured such that with the second gear 232 being in a freely rotatable state by an electromagnetic clutch or the like, the first gear 231 freely rotates in the counterclockwise direction and the second gear 232 freely rotates in the clockwise direction.

Since the toner cartridge pulling portion 380 is configured as such, it is possible to move the toner cartridge 130 by the pulling portion 381 by operating the solenoid 383.

Note that, though not shown, the top surface in the driving side of the toner cartridge 130 used therefor may be set as appropriate to have inclination, for example, having a shape that is not hitched by the pulling portion 381 when the toner cartridge 130 is inserted in the storage portion 210.

Next, description will be given for procedure for replacing the toner cartridge 130 using the toner cartridge pulling portion 380 for the configuration of the toner cartridge supporting apparatus of the image forming apparatus 1A with reference to the flowchart.

Figure 20:
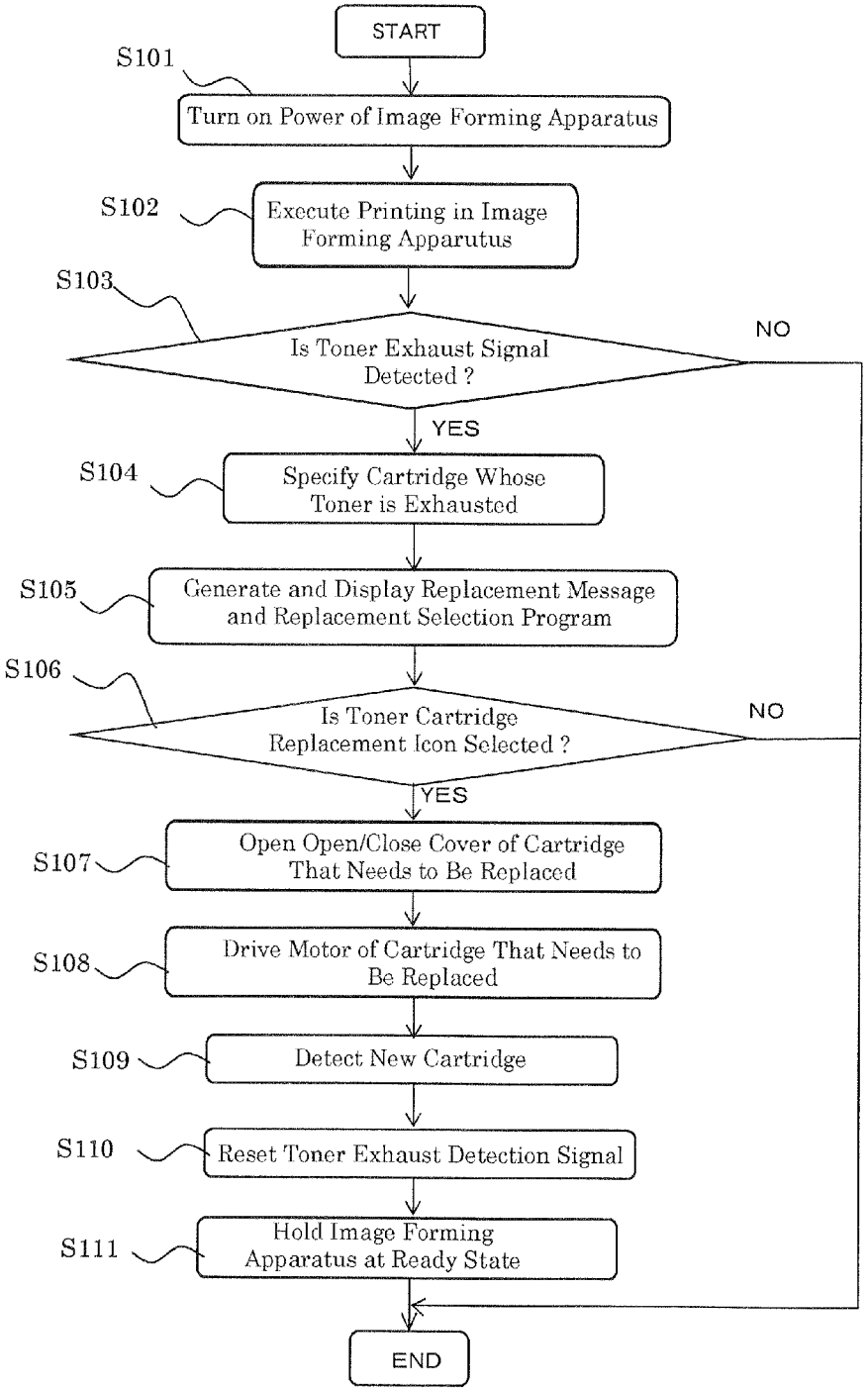
FIG. 20 is a flowchart showing procedure for replacing a toner cartridge by the above toner cartridge supporting apparatus.

FIG. 20 is a flowchart showing procedure for replacing a toner cartridge by the toner cartridge supporting apparatus of the image forming apparatus of the second embodiment.

As shown in FIG. 20, when power of the image forming apparatus 1A is turned on (step S101) to execute printing of the image forming apparatus 1A (step S102), the detecting portion 509*a* detects the toner remaining amount and the judging portion 503 judges whether or not the toner of the toner cartridge 130 is exhausted (step S103).

For example, the detecting portion 509*a* may be configured such that when the toner of the toner cartridge 130 is exhausted, a signal outputted when a not-shown switch is turned on serves as a toner exhaust signal.

When the judging portion 503 judges that the toner of the toner cartridge 130 is not exhausted at step S103, the replacement processing of the toner cartridge 130 by the toner cartridge supporting apparatus 200 is completed.

On the other hand, depending on the detection result by the detecting portion 509*a* judged by the judging portion 503 that the toner of the toner cartridge 130 is exhausted corresponds to which color of the toner cartridge 130, the toner cartridge 130 whose toner is exhausted is specified (step S104).

Then, the message generating portion 512 reads and generates the toner cartridge replacement message and the toner cartridge replacement program stored in the storage portion 502, and as shown in FIG. 8, the toner cartridge replacement message 110*a* and the toner cartridge replacement icon 112 are displayed on the display portion 101.

Whether or not the toner cartridge replacement icon 112 is selected is then judged (step S106).

When it is judged that the toner cartridge replacement icon 112 is not selected at step S106, the replacement processing of the toner cartridge 130 by the toner cartridge supporting apparatus 200 is completed.

On the other hand, when it is judged that the toner cartridge replacement icon 112 is selected at step S106, the drive motor (not shown) for opening the opening/closing cover 230 of the toner cartridge 130 which needs to be replaced is driven to open the corresponding opening/closing cover 230 (step S107). Then, the toner cartridge pulling portion 380 of the toner cartridge 130 which needs to be replaced is operated to move the toner cartridge 130 to the ejection position P2 or the ejection position P3 (step S108).

In the second embodiment, when the toner cartridge 130 is moved to the ejection position by the toner cartridge pulling portion 380, the opening/closing cover 230 is opened and the toner cartridge 130 goes outside to be in the state which can be confirmed by the user, so that it is possible to confirm easily which toner cartridge 130 is to be replaced.

Upon replacement to a new toner cartridge, then the detecting portion 509*a* detects that the new toner cartridge 130 is mounted (step S109).

When it is confirmed that the new toner cartridge 130 is attached, the control portion 501 resets the toner exhaust signal detected by the detecting portion 509*a* (step S110), and holds the image forming apparatus 1A at a ready state (standby state) (step S111).

Then, the replacement processing of the toner cartridge 130 by the toner cartridge supporting apparatus 200 of the second embodiment is completed.

As described above, according to the toner cartridge supporting apparatus of the second embodiment using the toner cartridge pulling portion 380, when the toner of the toner cartridge 130 attached to the image forming apparatus 1A is exhausted, the toner cartridge 130 is moved to the ejection position by the toner cartridge pulling portion 380, and therefore the opening/closing cover 230 is opened and the toner cartridge 130 is in the state of being projected from the storage portion 210, so that it is possible to confirm easily which toner cartridge 130 is to be replaced. In addition, it is possible to easily replace the toner cartridge 130.

In addition, by using the gear configuration as the opening portion of the opening/closing cover 230, it is possible to perform the opening/closing operation of the opening/closing cover 230 smoothly and reliably with a simple configuration.

With the configuration describe above, according to the first embodiment and the second embodiment, as the configuration of the toner cartridge supporting apparatus 200 of the image forming apparatus 1A, the storage portion 210, the insertion port 220 and the opening/closing cover 230 are provided, and the detecting portion 509*a* and the control portion 501 are provided, and further the judging portion 503 for judging whether or not the toner in the toner cartridge 130 is exhausted based on the detection result by the detecting portion 509*a*, the message generating portion 512, the display portion 101 for displaying the toner cartridge replacement message, the toner cartridge replacement icon 112 and the toner cartridge moving portion 280 are provided, and the toner cartridge replacement message display function 501*a* and the toner cartridge movement instruction function 501*b* are provided as the control portion 501, so that it is possible to determine which toner cartridge 130 is to be replaced in one glance, and to seek to improve convenience of the replacement work with the toner cartridge held easily.

Moreover, according to the first embodiment, it is configured such that by employing the toner cartridge moving portion 280, when the toner cartridge 130 is replaced, the opening/closing cover 230 is pressed to be opened at the time of moving the toner cartridge 130 to the ejection position P2 or P3, so that it is not necessary to separately provide a driving device for opening the opening/closing cover 230, thus making it possible to provide an inexpensive toner cartridge supporting apparatus with less number of parts.

On the other hand, according to the second embodiment, by employing the toner cartridge pulling portion 380 and the gear configuration as the opening portion of the opening/closing cover 230 for the configuration of the toner cartridge supporting apparatus, it is possible to perform the opening/closing operation of the opening/closing cover 230 smoothly and reliably with a simple configuration.

Note that, though the operation panel 100 as the display portion is fixed to the main apparatus body in the image forming apparatus 1A of the embodiments described above, the configuration of the display portion is not limited thereto in the present invention as far as the display portion is provided.

Modified examples of the display portion (operation panel 100) of the embodiments described above will be shown below.

Figure 21B:
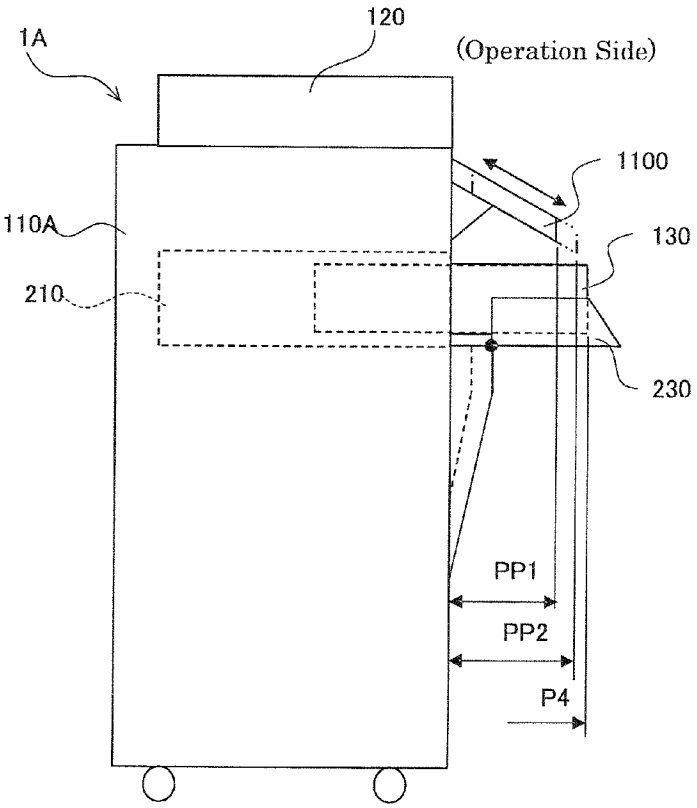
FIG. 21A and FIG. 21B are illustrative views showing a modified example 1 of a display portion constituting the toner cartridge supporting apparatus of the present invention.
Figure 21A:
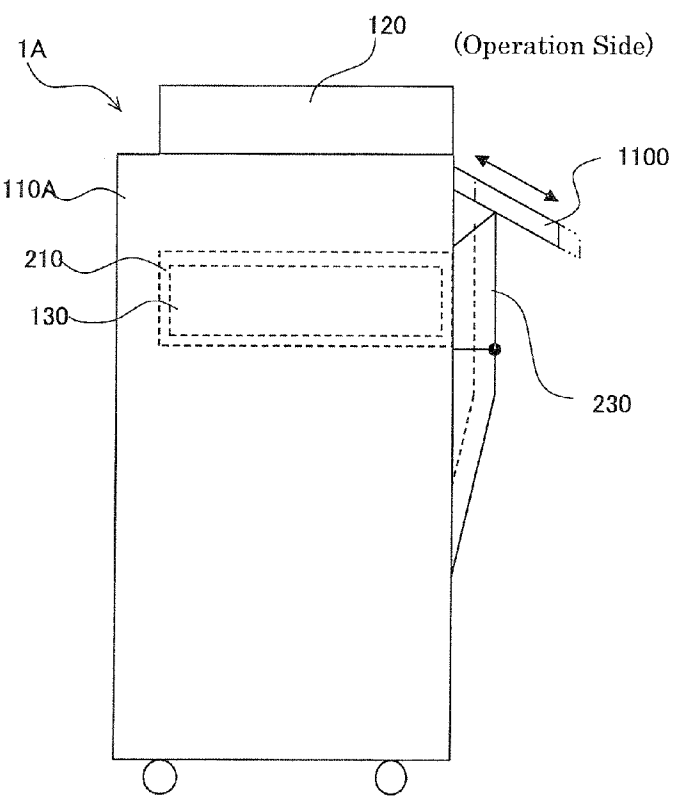
Figure 22B:
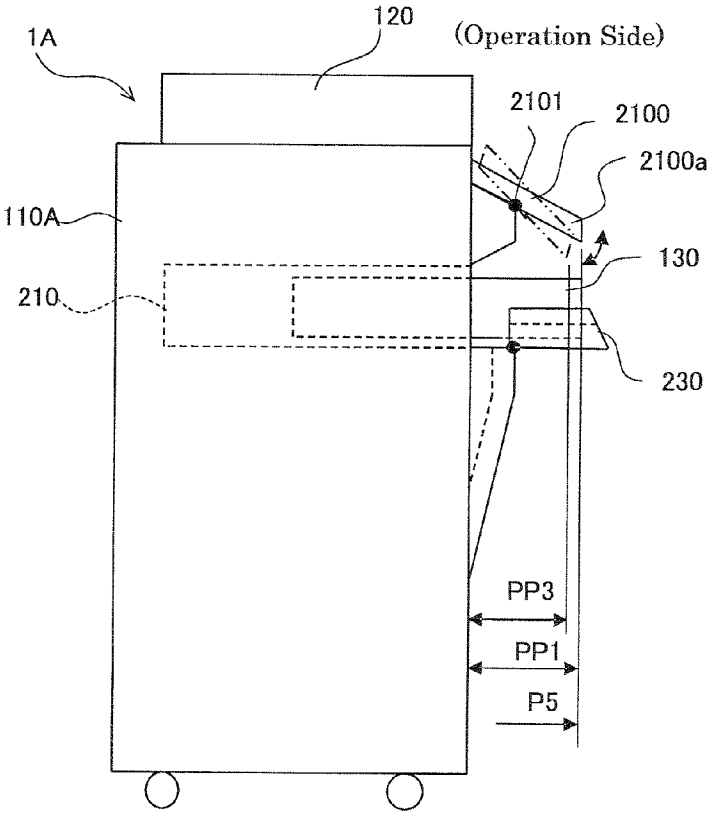
FIG. 22A and FIG. 22B are illustrative views showing a modified example 2 of the above display portion.
Figure 22A:
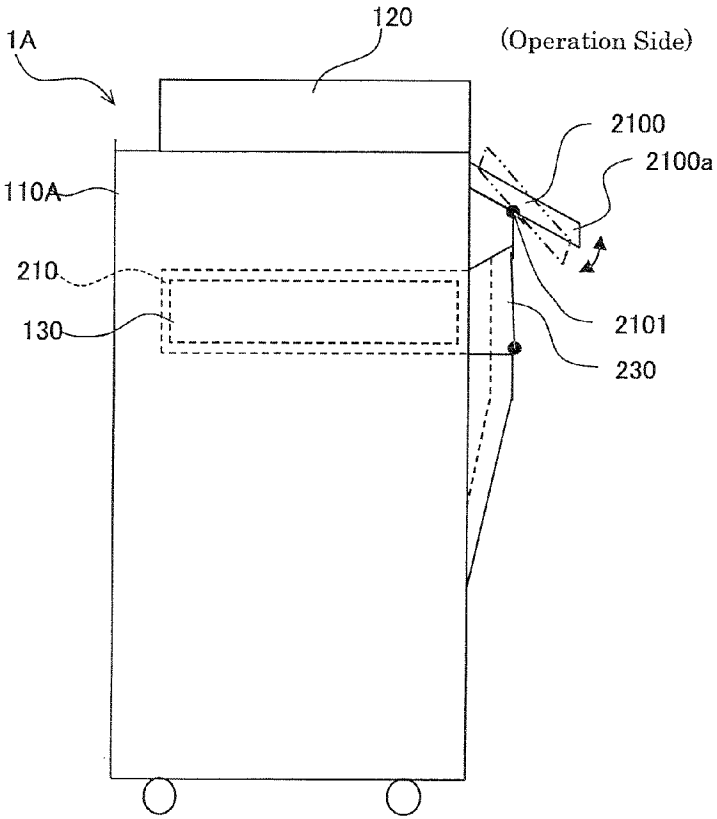

FIG. 21A is an illustrative view showing a modified example 1 of the display portion constituting the toner cartridge supporting apparatus of the present invention, FIG. 21B is an illustrative view showing a state when a toner cartridge below the above display portion is ejected, FIG. 22A is an illustrative views showing a modified example 2 of the above display portion, and FIG. 22B is an illustrative view showing a state when a toner cartridge below the above display portion is ejected.

Note that, descriptions for the similar configuration to that of the embodiments described above in the image forming apparatus 1A shown in the drawings will be omitted with the same reference numerals applied.

MODIFIED EXAMPLE 1

The modified example 1 is such that as shown in FIG. 21A and FIG. 21B, an operation panel 1100 which slides in an open direction of the opening/closing cover 230 is provided in the main apparatus body 110A of the image forming apparatus 1A.

The operation panel 1100 includes the display function and the operation function similar to those of the operation panel 100 of the embodiments described above.

The operation panel 1100 is configured so as to be able to be pulled to the vicinity of a user by sliding to the operation side. The position shown in the solid line in the figure is a normal position PP1 of the operation panel 1100 and the position shown in the two-dot chain line is a movement position PP2 when the operation panel 1100 is slid.

With this configuration, even a user who needs a wheel chair is able to pull the operation panel 1100 to the user side, so that visibility of the operation panel 1100 is improved and it is possible to perform the input operation easily without being hindered by the wheelchair.

Moreover, in the modified example 1, an ejection position P4 of the toner cartridge 130 when the opening/closing cover 230 is arranged below the operation panel 1100 is positioned being projected to the operation side compared to a position PP2 of an end portion of the operation side of the operation panel 1100 which is slid.

With this configuration, it is possible to easily confirm the toner cartridge 130 which needs to be replaced even when the operation panel 1100 is in the slid state, and to perform the replacement of the toner cartridge easily.

MODIFIED EXAMPLE 2

The modified example 2 is such that as shown in FIG. 22A and FIG. 22B, an operation panel 2100 in which an operation angle is able to be changed is provided in the main apparatus body 110A of the image forming apparatus 1A.

The operation panel 2100 includes an angle change fulcrum 2101 which allows changing of an inclination angle of the operation panel 2100 with respect to the main apparatus body 110A.

The operation panel 2100 includes the display function and the operation function similar to those of the operation panel 100 of the embodiments described above.

The operation panel 2100 is configured such that an operation side end portion 2100*a* is rotatable downward (to the position shown in the two-dot chain line) at an inclination angle desired by the user. The position shown in the solid line in the figure is a normal position PP1 of the operation panel 2100 and the position shown in the two-dot chain line is a movement position PP3 when the operation panel 2100 is rotated to be inclined.

With this configuration, it is possible to arrange the operation panel 2100 at a desirable inclination angle by rotation depending on the user, so that visibility of the operation panel 2100 is improved and it is possible to perform the input operation easily.

Moreover, in the modified example 2, an ejection position P5 of the toner cartridge 130 when the opening/closing cover 230 is arranged below the operation panel 2100 is approximately the same position as the normal position PP1 of the operation side end portion of the operation panel 2100.

With this configuration, it becomes easy to see the toner cartridge 130 which needs to be replaced in the state where the operation panel 2100 is rotated to be inclined, so that it is possible to easily confirm the toner cartridge 130, and to perform the replacement of the toner cartridge easily.

Note that, in the modified example 1, the configuration of a slide portion of the operation panel 1100 may use, for example, a guide, an accuride or the like as the slide portion.

In addition, in the modified example 2, the configuration of an angle change portion of the operation panel 2100 may be the configuration in which the operation panel 2100 is rotatable to be inclined about the angle change fulcrum 2101 and is able to be fixed in the mid-state of being rotated to be inclined.

Further, in the embodiments and modified examples described above, though description has been given with the image forming apparatus 1A as the single apparatus, the present invention may be configured such that the image forming apparatus is remotely controlled, for example, by a sales company of the image forming apparatus through a LAN (local area network). In addition, it may be configured such that, for example, the control portion of the image forming apparatus is remotely controlled by a not-shown control portion of a server of a sales company.

(Third Embodiment)

Description will be given below for an example in which the image forming apparatus 1A of the embodiments described above is remotely controlled through a LAN with reference to the drawing.

Figure 23:
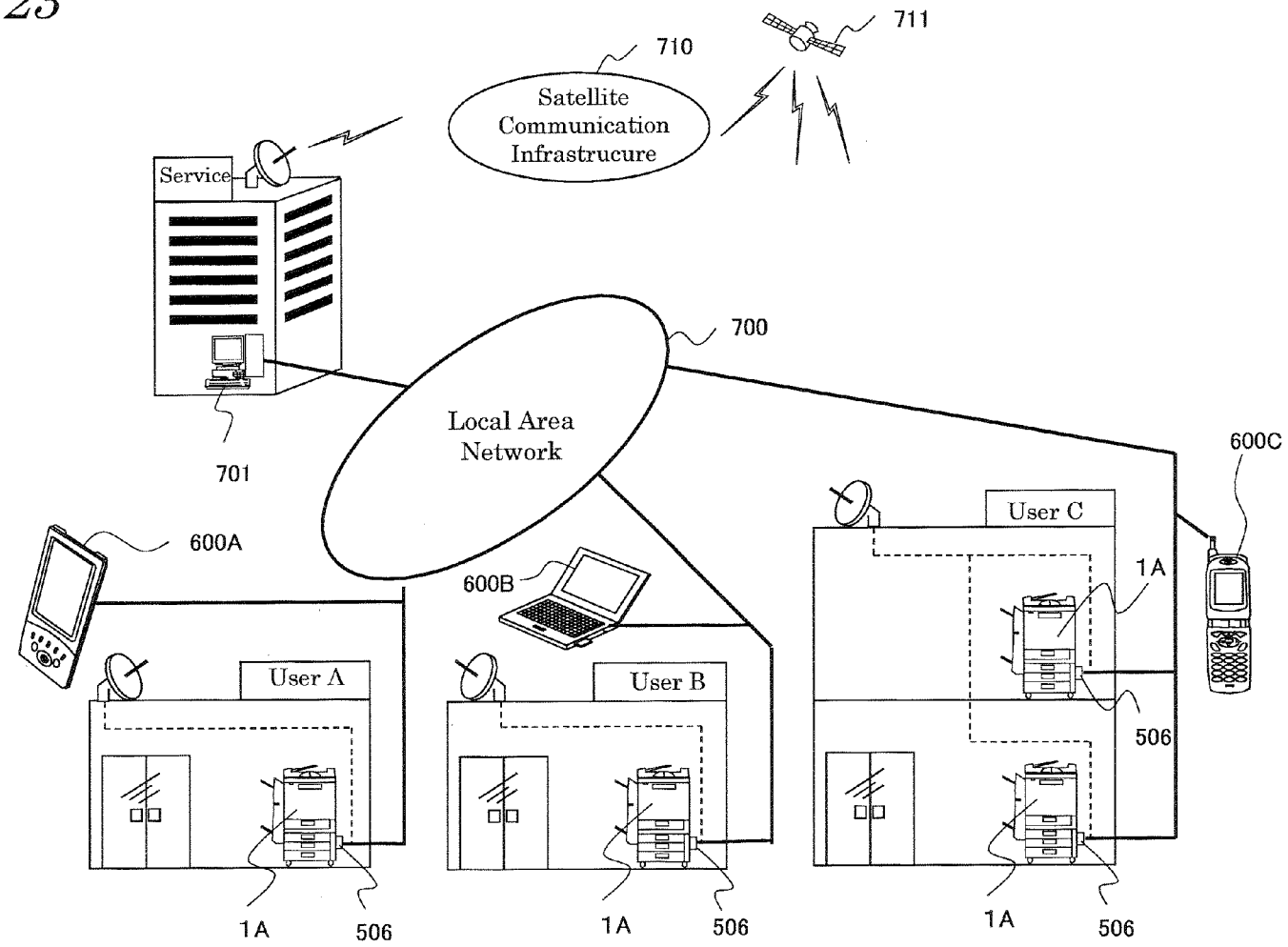
FIG. 23 is an illustrative view showing an example of a communication network used for an image forming apparatus according to a third embodiment of the present invention.

FIG. 23 is an illustrative view showing an example of a communication network used for an image forming apparatus according to a third embodiment of the present invention.

In the third embodiment, as shown in FIG. 23, the image forming apparatus 1A is connected to a data management server 701 of a manufacturer, a sales destination, a lease destination or the like through a LAN (local area network) 700 by a communication portion 506.

In the present embodiment, the image forming apparatus 1A and the data management server 701 of the sales destination of the image forming apparatus 1A are connected through the LAN (local area network (communication portion)) 700 as communicative connection so as to be configured such that usage status of the toner cartridge 130 of the image forming apparatus 1A is able to be monitored by the sales destination.

For example, as shown in FIG. 23, a plurality of users A, B and C are able to use each of the communication portions 506 of the image forming apparatuses 1A serving as terminal devices, or each of a portable terminal 600A, a PC 6002 of the user B and a mobile phone 600C of the user C to connect to the data management server 701 of a sales shop or a lease company of the image forming apparatuses and consumables though the LAN (local area network) 700 or to communicatively connect though satellite communication infrastructure 710 using a communication satellite 711. This makes it possible to reliably inform the image forming apparatus 1A that the toner cartridge 130 becomes needed to be replaced even when the user is in the place away from the image forming apparatus 1A.

As the LAN (local area network) 700, in the case of wired one, 10BASE-T, 100BASE-TX, 10GABASE-T and the like of the Ethernet (registered trademark) specification, and 10BASE-F, 100BASE-F, 1000BASE-X, 10GBASE-R, 10GBASE-W and 10GBASE-X of the optical multi mode thereof, and in the case of wireless one, IEEE 802.16 (broadband wireless specification), IEEE 802.16a (standard specification of fixed wireless communication, one with operating frequency band of the IEEE 802.16 specification changed) or IEEE 802.16-2004 (system used in a fixed section, otherwise known as IEEE 802.16a/REVd) of WiMAX, WAN, and cloud computing service (dedicated business owner: cloud provider) are also usable.

Note that, a communicative connecting system of the image forming apparatus 1A and the data management server 701 is not particularly limited, and Internet, intranet, extranet, ISDN, VAN, CATV communication network, virtual private network, telephone line network, mobile communications network and the like are usable, for example.

Further, a transmission medium that constitutes the communications network is not particularly limited, and even wired ones such as IEEE 1394, USB, power-line carrier, cable TV lines, telephone lines, and ADSL lines and wireless ones such as IrDA and infrared rays of remote controllers or the like, Bluetooth (registered trademark), 802.11 wireless, HDR, mobile phone network, satellite lines, and terrestrial digital network are also usable, for example.

In addition, as the storage portion 502 of the image forming apparatus 1A and a not-shown storage portion (storage portion) of the data management server 701, for example, tapes such as magnetic tapes and cassette tapes, disks including magnetic disks such as floppy (registered trademark) disks/hard disks, and optical disks such as CD-ROMs/MOs/MDs/DVDs/CD-Rs/Blu-rays, cards such as IC cards (including memory cards)/optical cards, semiconductor memories such as mask ROMs/EPROMs/EEPROMs/flash ROMs, or the like are usable.

Further, as the configuration of the display portion 101 of the image forming apparatus 1A, a liquid crystal display, an organic electro-luminescence display, a plasma display, a plasma tubes array display, an electronic paper display using electrophoresis or the like, or a display using electron emission elements (field emission display, surface-conduction electron-emitter display) is usable, and a display apparatus including a display portion such as a multi display in combination thereof is usable.

Note that, in the embodiments described above, though description has been given for the example in which the configuration of the toner cartridge supporting apparatus according to the present invention is applied to the image forming apparatus 1A having the operation panel 100 as shown in FIG. 1, it is not limited to an image forming apparatus with the configuration described above or a copier as far as the apparatus includes a display portion capable of displaying a message and the like, and is able to be developed into an inkjet recording apparatus or other apparatuses such as, for example, home electric appliances, consumer equipments (which refer to ones aiming to be used by general consumers and used in ordinary houses in electronic equipments, apparatuses or terminals related to video, sound, communication and the like, or products and specifications developed and designed on the assumption thereof), commercial equipments (products developed on the assumption of usage in corporate (companies, schools and civil service) and the like other than ordinary houses) and the like.

In addition, though the touch panel is used as the input portion 505, a gesture input device using Ubi-Finger device etc. or the like may be used.

Having described heretofore, the present invention is not limited to the embodiments described above, and various changes can be made within the scope shown in the claims. That is, any embodiments obtained by combination of technical portions modified as appropriate without departing from the scope of the present invention should also be included in the technical range of the present invention.

What is claimed is:

1. A toner cartridge supporting apparatus comprising:

a storage portion for storing a toner cartridge;

an insertion port for inserting the toner cartridge in the storage portion;

an opening/closing cover for covering the insertion port;

a detecting portion for detecting a toner remaining amount in the toner cartridge stored in the storage portion;

a control portion for selectively causing toner to be supplied from the toner cartridge;

a judging portion for judging whether or not the toner in the toner cartridge is exhausted based on a detection result by the detecting portion;

a message generating portion for generating a toner cartridge replacement message for notifying that the toner cartridge is to be replaced based on a judgment result by the judging portion;

a display portion for displaying the toner cartridge replacement message generated by the message generating portion;

a toner cartridge replacement instruction portion for instructing to replace the toner cartridge;

a toner cartridge moving portion for moving the toner cartridge from a toner supply position in the storage portion to an ejection position on a side of the insertion port, and an opening portion for opening and closing the cover, wherein the control portion performs:

a function of causing the display portion to display the toner cartridge replacement message when the judging portion judges that the toner in the toner cartridge is exhausted;

a function of causing the opening portion to open the opening/closing cover after the replacement of the toner cartridge is instructed by the toner cartridge replacement instruction portion; and a function of causing the toner cartridge moving portion to move the toner cartridge from the toner supply position to the ejection position after the opening/closing cover has been opened by the opening portion.

2. The toner cartridge supporting apparatus according to claim 1, wherein the toner cartridge is inserted in the storage portion in an approximately horizontal direction, and the ejection position of the toner cartridge is arranged in a position that an end portion on the side of the insertion port of the toner cartridge is projected toward an external side of the insertion port from the storage portion.

3. The toner cartridge supporting apparatus according to claim 2, wherein the display portion is disposed to be projected outward in an approximately horizontal direction side with respect to the insertion port at a top part of the insertion port, and the ejection position of the toner cartridge positioned below the display portion is arranged in a position at which the end portion on the side of the insertion port of the toner cartridge is projected outward in the approximately horizontal direction side with respect to an end portion of the display portion.

4. The toner cartridge supporting apparatus according to claim 1, wherein the storage portion is formed such that a space cross-sectional area on the side of the insertion port is larger than a space cross-sectional area on an opposite side of the insertion port in a space cross-sectional area in a vertical direction.

5. The toner cartridge supporting apparatus according to claim 1, wherein the storage portion comprises a guide member for guiding the toner cartridge along a longitudinal direction of the toner cartridge stored inside the storage portion.

6. The toner cartridge supporting apparatus according to claim 1, wherein the toner cartridge moving portion comprises a pressing portion for pressing at least a part of the toner cartridge or a pulling portion for pulling at least a part of the toner cartridge.

7. The toner cartridge supporting apparatus according to claim 1, wherein the display portion includes a touch panel or an operation key.

8. An image forming apparatus comprising the toner cartridge supporting apparatus according to claim 1.

9. A toner cartridge supporting method comprising:

detecting an amount of toner remaining in a toner cartridge stored in a storage portion;

selectively causing toner to be supplied from the toner cartridge;

judging whether or not the toner in the toner cartridge is exhausted based on a detection result of detecting an amount of toner remaining amount in the toner cartridge;

generating a toner cartridge replacement message that notifies that it is time to replace the toner cartridge based on a judgment result;

displaying the replacement message by means of a display portion when it is judged that the toner in the toner cartridge is exhausted;

opening an opening/closing cover configured to cover an insertion port after a user issues a toner cartridge replacement instruction by selecting the replacement message displayed on the display portion; and moving the toner cartridge from the toner supply position to an ejection position after the opening/closing cover has been opened.

* * * * *